US005735113A

United States Patent [19]

Cadenhead, Sr.

[11] Patent Number: 5,735,113

[45] Date of Patent: Apr. 7, 1998

[54] ANTI-CHOKING SPINDLE WITH CYLINDER HAVING THREAD CUTTING SLOTS

[75] Inventor: Roy Alton Cadenhead, Sr., Calhoun, Ga.

[73] Assignee: Modern Fibers, Inc., Calhoun, Ga.

[21] Appl. No.: 638,220

[22] Filed: Apr. 26, 1996

Related U.S. Application Data

[63] Continuation-in-part of Ser. No. 275,723, Jul. 19, 1994, abandoned.

[51] Int. Cl.[6] ..... D01H 9/00; D01H 9/14

[52] U.S. Cl. ..... 57/306; 57/58.3; 57/58.49; 57/86; 57/87; 57/303; 242/19; 242/22; 242/48

[58] Field of Search ..... 242/18 EW, 19, 242/21, 48; 57/58.3, 58.49, 58.7, 58.52, 58.54, 86, 88, 89, 87, 78, 104, 105, 276, 299, 303, 306

[56] References Cited

U.S. PATENT DOCUMENTS

| | | | |
|---|---|---|---|
| 2,640,310 | 6/1953 | Roberts | 57/81 |
| 2,730,859 | 1/1956 | Gatling | 57/58.3 |
| 2,879,639 | 3/1959 | Butcher | 57/88 |
| 2,892,302 | 6/1959 | Whitehead | 57/88 |
| 2,958,177 | 11/1960 | Seidl | 57/58.3 |
| 3,162,993 | 12/1964 | Green | 57/34 |
| 3,359,714 | 12/1967 | Sanders | 57/56 |
| 3,530,657 | 9/1970 | Grau | 57/34 |
| 3,731,479 | 5/1973 | Flowers et al. | 57/131 |
| 3,768,242 | 10/1973 | Angst et al. | 57/34 PW |
| 3,801,038 | 4/1974 | Wust | 242/19 |
| 3,805,504 | 4/1974 | Franzen | 57/81 |
| 3,929,027 | 12/1975 | Sharychenkov | 74/242.15 R |
| 3,967,440 | 7/1976 | Narumi et al. | 57/34 TT |
| 4,117,655 | 10/1978 | Smith | 57/58.83 |
| 4,120,142 | 10/1978 | Franzen | 57/34 R |
| 4,167,094 | 9/1979 | Verdollin | 57/58.72 |
| 4,179,082 | 12/1979 | Suzuki | 242/129.51 |
| 4,315,397 | 2/1982 | Matas Gabalda | 57/58.49 |
| 4,334,405 | 6/1982 | von Colson | 57/300 |
| 4,445,320 | 5/1984 | Oppl et al. | 57/88 |
| 4,453,377 | 6/1984 | Inger et al. | 57/279 |
| 4,505,099 | 3/1985 | Fukunaga et al. | 57/86 |
| 4,574,575 | 3/1986 | Franzen | 57/80 |
| 4,578,939 | 4/1986 | Springfield | 57/58.36 |
| 4,796,422 | 1/1989 | Odawara | 57/299 |
| 4,854,116 | 8/1989 | Lorenz et al. | 57/58.84 |
| 4,870,815 | 10/1989 | Marchiori et al. | 57/299 |

FOREIGN PATENT DOCUMENTS

| | | | |
|---|---|---|---|
| 3641866 | 7/1987 | Germany | 57/304 |
| 45-31263 | 10/1970 | Japan | 57/58.49 |
| 178164 | 9/1985 | Japan | 242/19 |
| 596671 | 3/1978 | U.S.S.R. | 57/303 |

*Primary Examiner*—William Stryjewski
*Attorney, Agent, or Firm*—Fitzpatrick, Cella, Harper & Scinto

[57] ABSTRACT

A yarn spindle is provided having a housing, a spindle drive shaft rotatably mounted in the housing, and a cylinder fixedly attached to the spindle drive shaft. The cylinder includes a downwardly extending circumferential skirt, with the skirt and the spindle drive shaft defining an annular space between them. The skirt has a bottom edge with at least four thread cutting slots disposed therein, the slot being a substantially rectangular notch through the thickness of the skirt. The at least four thread cutting slots are equally spaced about the bottom edge. The spindle also includes a waste thread spool statically mounted on the housing for shielding the spindle drive shaft against contact with waste yarn. The waste thread spool includes a frusto-conical barrel having a top end, a bottom end, an axial hole, and an inclined outer wall. The outer wall is angled approximately 30 to 35 degrees from the vertical and has a substantially vertical groove formed therein. The radius of the barrel increases from bottom to top, and the barrel extends upward, underneath the skirt, into the annular space between the skirt and the spindle drive shaft. The spindle further includes a drive assembly for use with a drive belt, the drive assembly being coupled to and thereby powering the spindle drive shaft.

42 Claims, 16 Drawing Sheets

ANTI-CHOKING SPINDLE WITH CYLINDER HAVING THREAD CUTTING SLOTS

This application is a continuation-in-part of application No. 08/275,723, filed Jul. 19, 1994, now abandoned.

BACKGROUND OF THE INVENTION

1. Field of the Invention

The present invention relates to a yarn spindle for twisting yarn, and more particularly, to a yarn spindle providing advantageous resistance to jamming upon broken yarn.

2. Description of the Related Art

Conventional spindles for twisting yarn are prone to choking by broken yarn threads, which can cause damage to or destruction of the spindle. A conventional yarn spindle is illustrated in FIG. 1 in a cabling conformation. A strand 501 from the overhead creel 500 passes downward and enters the bottom of the conventional spindle, which is indicated generally as 400. The strand 501 then enters an axial bore 402 in the hollow spindle drive shaft (not shown), and passes vertically upward through spindle 400. Exiting the spindle horizontally through rotating cylinder 404 (often called a "flier disc"), the strand 501 passes out of base plate 406 and upward outside the spindle pot 506. The vertical route takes strand 501 above the pot, where it makes contact at point C (sometimes referred to as "the plying junction") with strand 503 from yarn creel package 502, which is seated in pot 506. At this contact point C, the two strands 501 and 503 are twined together and become a two-ply strand (sometimes called a "cord"), which is taken up as a twisted package on take-up reel 504.

If the strand 501 breaks at any point after exiting the base plate 406, the path brings it into the area of the rotating cylinder 404. As the loose tail of the strand 501 makes contact with the spindle 400, it can become wrapped around the spindle. Moreover, the strand 501 continues to be pulled out from the overhead creel 500 and through the spindle 400. As strand 501 winds on the spindle 400, it tends to enter any unprotected area. Because of the stress on strand 501, it can enter the smallest opening in the housing. Conventionally-designed spindles have gap areas, including, for example, those indicated generally as G1 and G2 in FIG. 1. As seen, gap area G2 is located directly below cylinder 404. These and other gap areas are extremely sensitive to intake of broken strands of yarn. Once the strand reaches the internal workings of the spindle, e.g. the spindle drive shaft 405 (not shown), heat generated by friction and the like can often melt the strand and gum up the interior of the spindle. The resultant jamming and fouling of the spindle requires demounting of the spindle from the twister frame, followed by disassembly and servicing.

Exterior guards have been proposed. For example, U.S. Pat. No. 4,167,094 (Verdollin) discloses a spindle for twisting machines that includes a circular deflector 32. U.S. Pat. No. 4,578,939 (Springfield) discloses a choke guard for a twisting machine spindle that includes a cylindrical member 90. U.S. Pat. No. 4,117,655 (Smith) discloses a 2-for-1 twister equipped with antiwrapping members 62 and a wrap guard 60. So far as I am aware, however, none of these devices has solved the problem of broken yarn jamming.

The yarn spindle of the present invention addresses the need for a spindle that is less susceptible to jamming.

SUMMARY OF THE INVENTION

According to one aspect of the present invention, there is provided a cylinder for use in a yarn spindle, the cylinder having at least one thread cutting slot.

According to another aspect of the present invention, there is provided an improved yarn spindle of the type having a housing, a spindle drive shaft rotatably mounted in the housing, and a cylinder fixedly mounted on the spindle drive shaft. The improvement includes a waste thread spool statically disposed about the spindle drive shaft below the cylinder. The spool includes a frusto-conical barrel with a top end, a bottom end, an axial hole, and an inclined outer wall. The radius of the barrel increases from bottom to top, with the top end being adjacent the cylinder. The spool shields the spindle drive shaft against contact with waste yarn.

According to another aspect of the present invention, there is provided an improved yarn spindle of the type having a housing, a spindle drive shaft rotatably mounted in the housing, and a cylinder fixedly mounted on the spindle drive shaft. The improvement includes a cylinder having a downwardly extending circumferential skirt defining an annular space between the skirt and the spindle drive shaft, and the waste thread spool described above, statically disposed about the spindle drive shaft below the cylinder. The radius of the barrel increases from bottom to top. The spool extends upward, underneath the skirt, into the annular space, with the top end of its barrel toward the cylinder.

The skirt of the cylinder preferably has a bottom edge with at least one thread-cutting slot disposed therein. The slot is advantageously a substantially rectangular notch through the thickness of the skirt. Preferably, at least four thread cutting slots will be located in the bottom edge, and preferably they will be substantially equally spaced apart.

The waste thread spool's inclined outer wall is preferably angled approximately 30 to 35 degrees from the vertical and has a substantially vertical groove formed therein to permit access of the point of a hook knife, to facilitate the removal of any yarn fragments that get wound around the spool. The top end of the barrel of the waste thread spool preferably has an outer circumferential edge that is disposed with a radial clearance from the skirt of about 0.010 to 0.020 inch. The clearance between the spindle drive shaft and the wall of the axial hole at the top end of the barrel of the waste thread spool is advantageously about 0.010 to 0.050 inch. The skirt of the cylinder overhangs the top end of the barrel by at least ¼ inch, most preferably by approximately 0.35 to 0.55 inch.

Optionally, the spindle may include a drive assembly for use with a drive belt, the drive assembly being coupled to and thereby powering the spindle drive shaft. The drive assembly may include a drive roller coupled to the spindle drive shaft, and an external shifting assembly for shifting the drive belt in and out of engagement with the drive roller. The external shifting assembly advantageously simplifies the internal construction of the spindle and avoids contamination of the spindle drive shaft bearings, a problem which may lessen the performance of clutch cone shifting assemblies.

Other aspects of the present invention will become apparent from the following description of the preferred embodiments of the invention, taken in connection with the accompanying drawings.

DETAILED DESCRIPTION OF THE PREFERRED EMBODIMENTS

Figure 1:
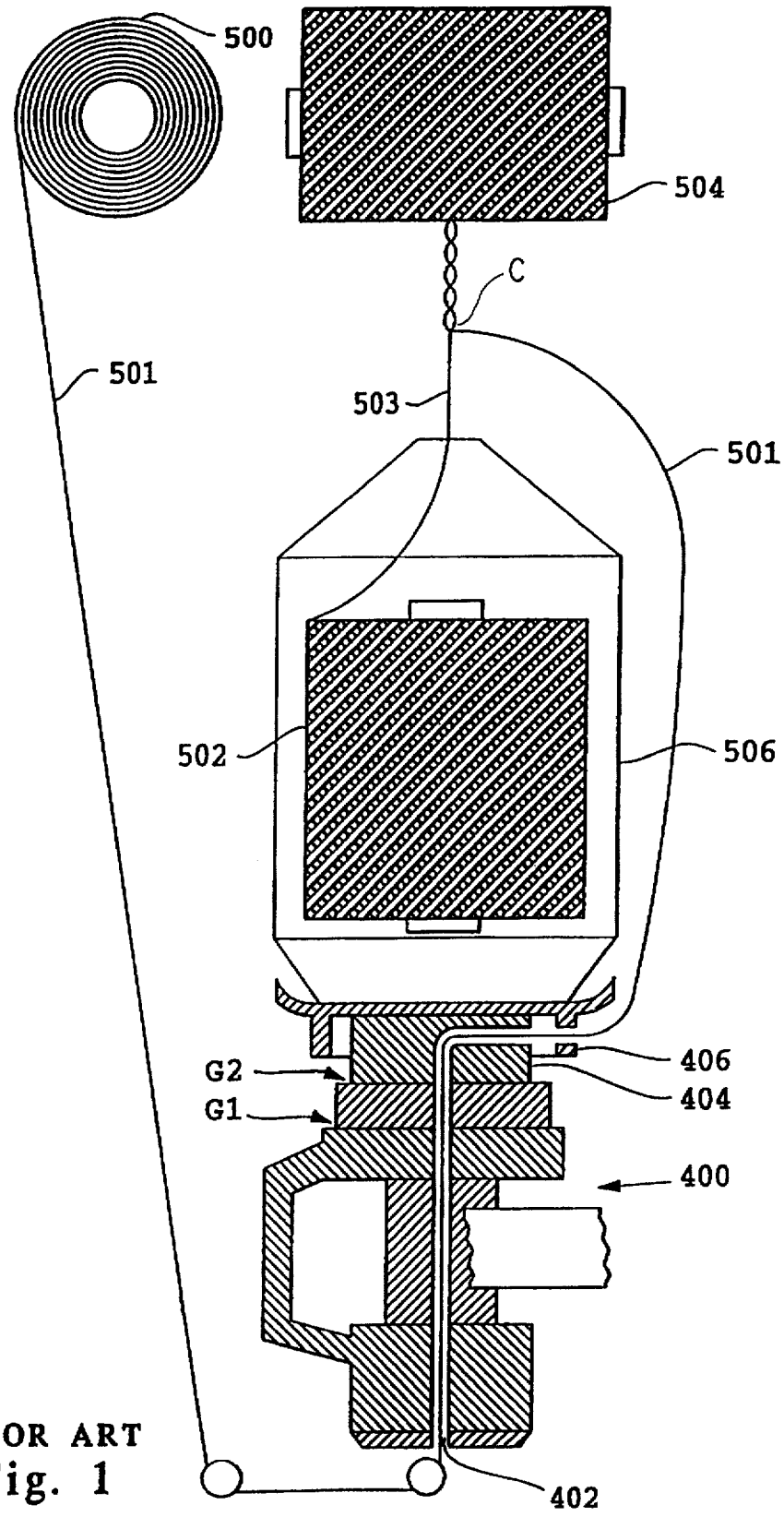
PRIOR ART Fig. 1
FIG. 1 is an orthographic break-away side view of a conventional yarn spindle.

Reference will now be made in detail to the presently preferred embodiments of the invention, examples of which are illustrated in the accompanying drawings. Whenever possible, the same reference numerals will be used throughout the drawings to refer to the same or like parts.

Figure 2:
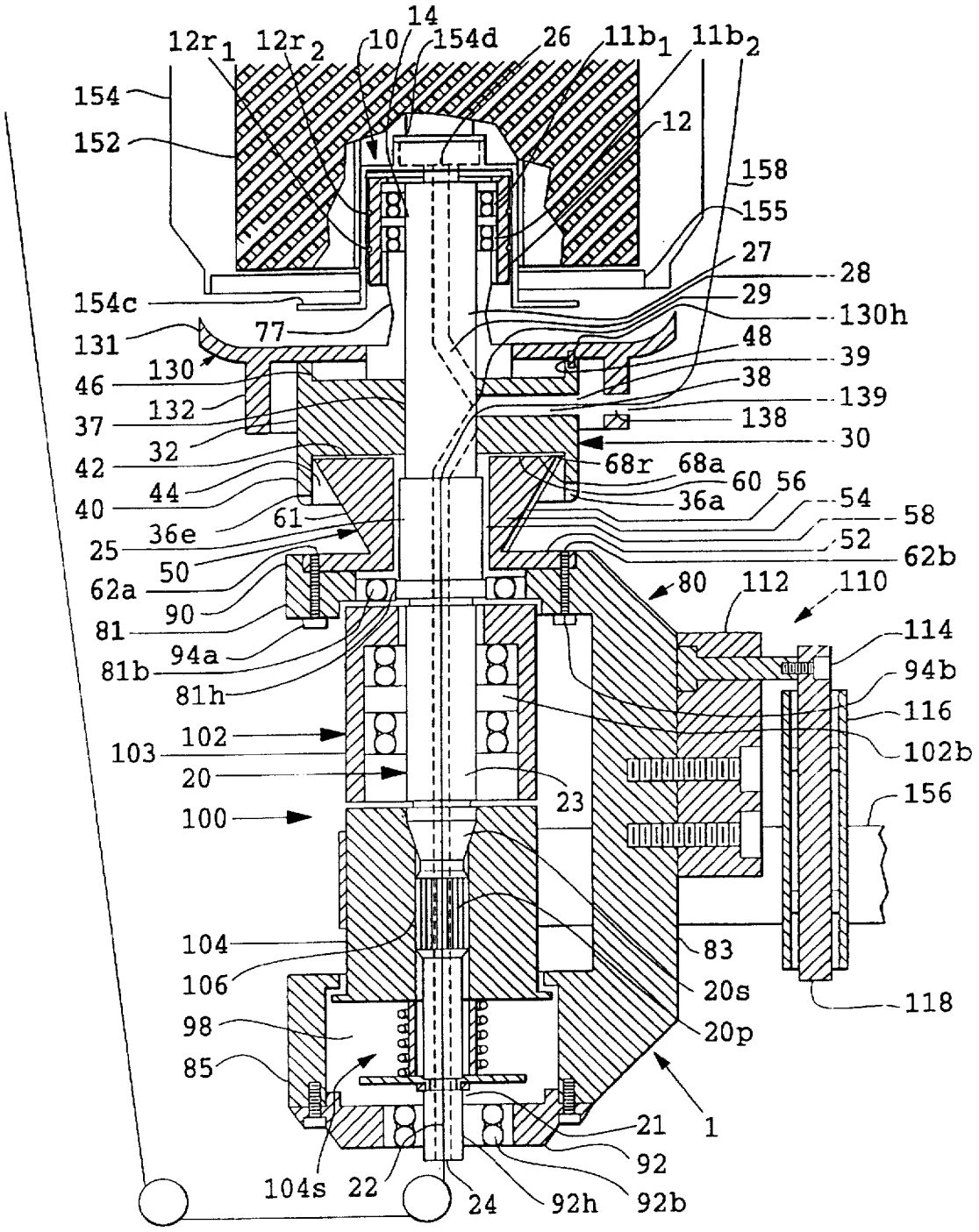
FIG. 2 is an orthographic sectional side view of an embodiment of a yarn spindle according to the present invention.

Referring to FIG. 2 of the drawings, a yarn spindle, indicated generally as 1, comprises a spindle housing, indicated generally as 80, a drive assembly, indicated generally as 100, a central spindle drive shaft, indicated generally as 20, a top bearing housing, indicated generally as 10, a cylinder, indicated generally as 30, and a stationary waste thread spool, indicated generally as 50.

Spindle housing 80, as depicted in FIGS. 2 through 5, comprises a generally U-shaped structure, with an upper housing portion 81, a central connector portion 83, and a lower housing portion 85. Upper housing portion 81 comprises a standard 5202 bearing **81*b* having a central annular bore 81*h*. Upper housing portion 81 also includes two radially extending mounting wings $81w_1$ and $81w_2$, with corresponding mounting holes for attaching spindle 1 to a standard frame (shown in FIGS. 4 and 5). A circumferential lip 90 is disposed on an upper surface of upper housing portion 81. Circumferential lip 90 defines a cylindrical space which accommodates the base 52 of waste thread spool 50. Central connector portion 83 supports a shifting assembly, indicated generally as 110, which is a part of drive assembly 100. Lower housing portion 85 has a downwardly facing cylindrical space 98, and comprises a cap 92 which closes off cylindrical space 98. Cap 92 comprises bearing 92*b* having a central bore 92*h*. Bearing 92*b* comprises a standard 6200** bearing.

Figure 4:
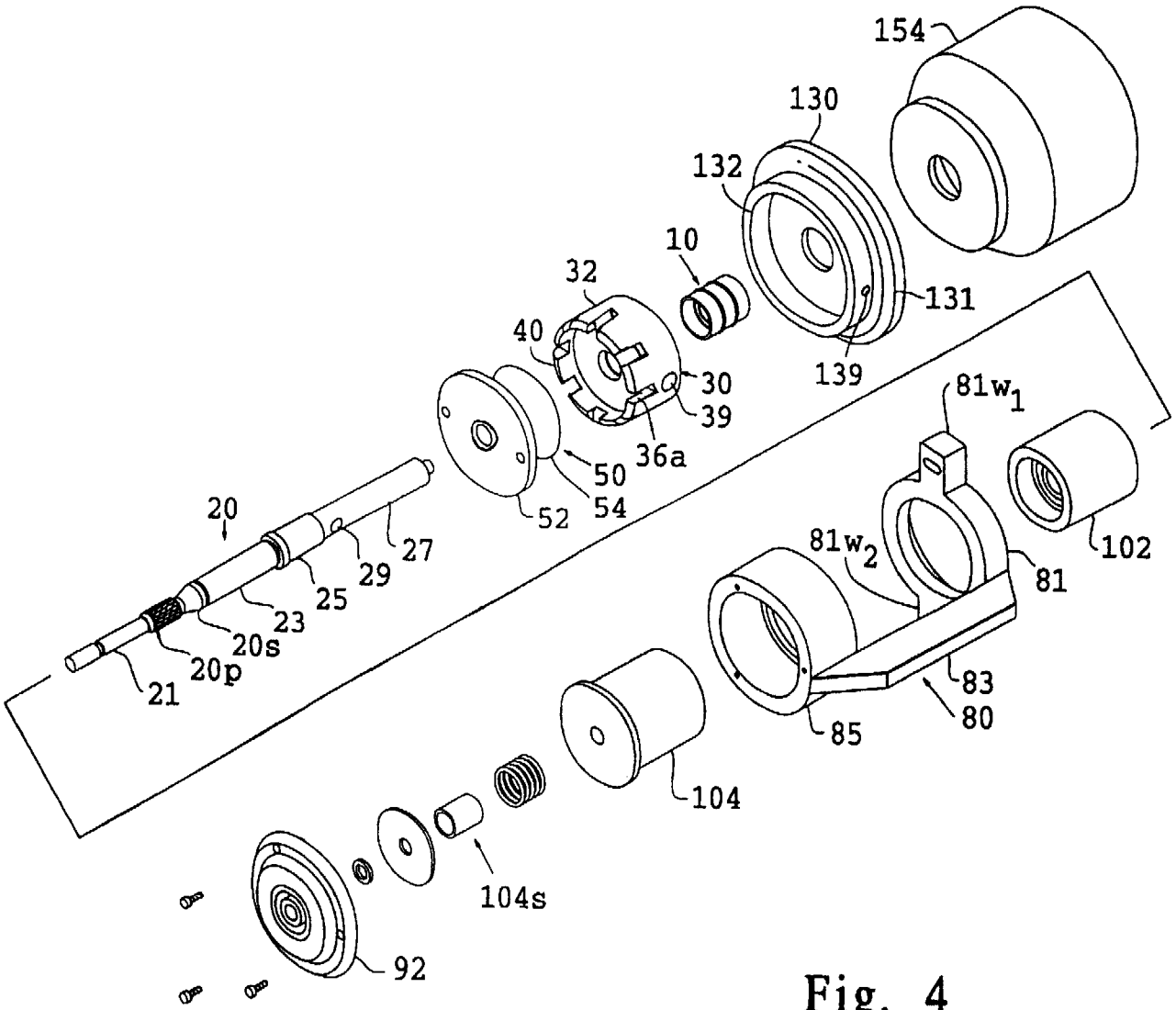
FIG. 4 is an isometric exploded view with an underside point of view of the yarn spindle as depicted in FIG. 2.
Figure 5:
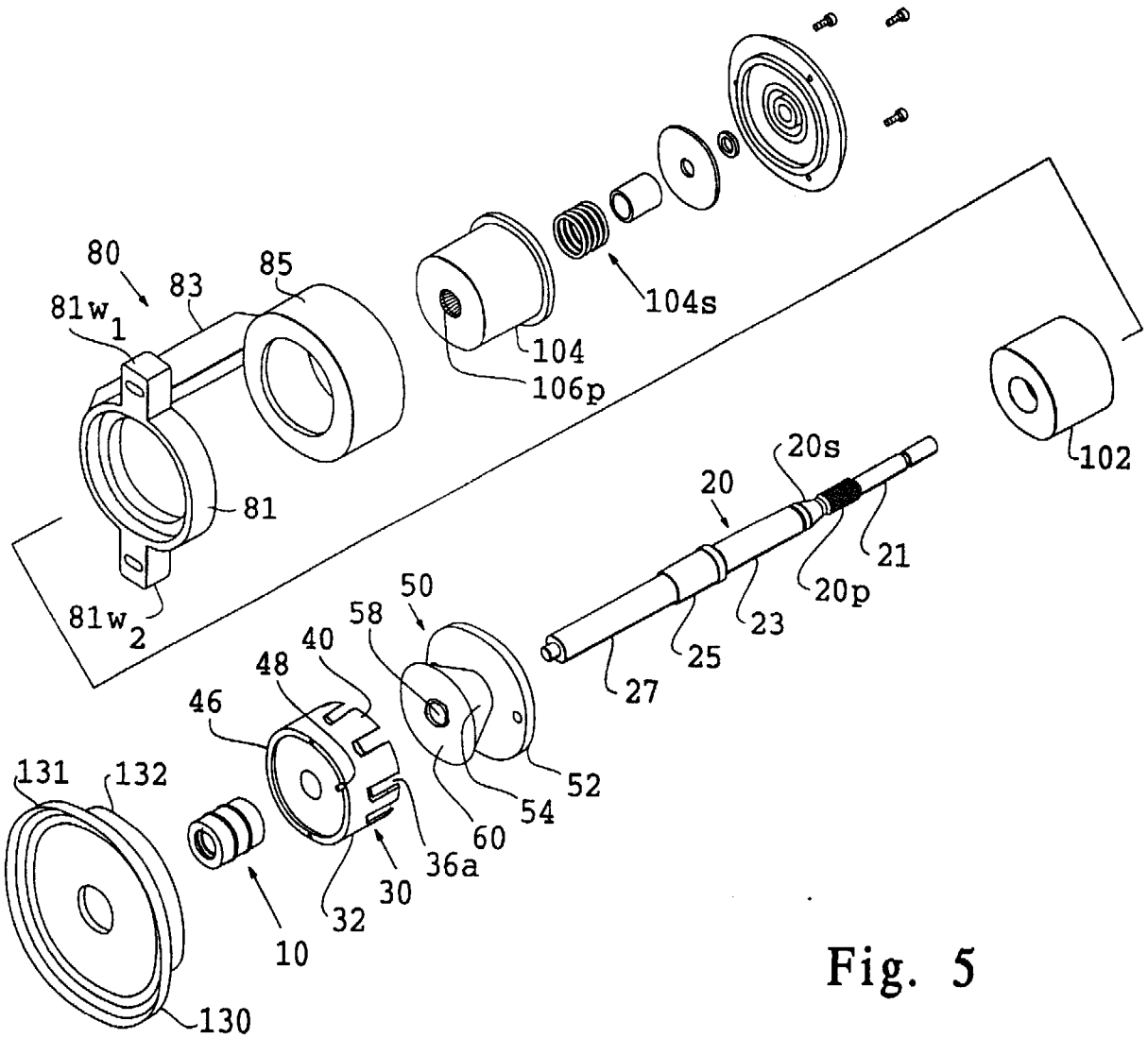
FIG. 5 is an isometric exploded view with a top point of view of the yarn spindle as depicted in FIG. 2.
Figure 10:
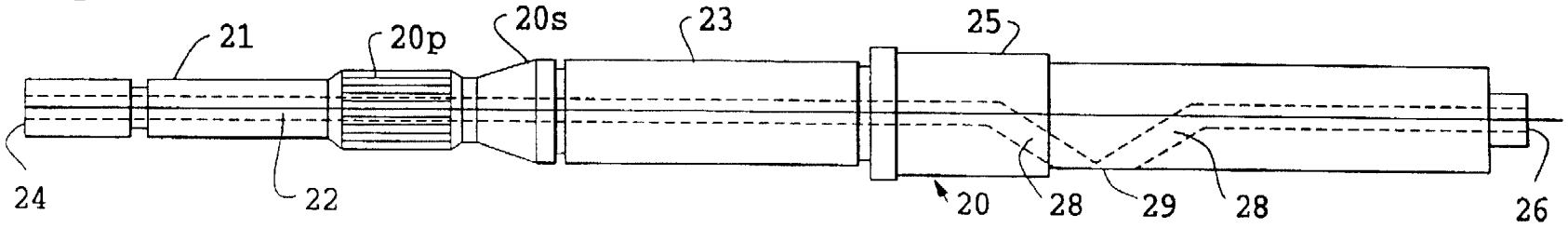
FIG. 10 is an orthographic detailed view of the preferred spindle drive shaft embodiment of the yarn spindle as depicted in FIG. 2.

Rotatably mounted in this spindle housing 80 is spindle drive shaft 20, as shown in FIGS. 2, 4, 5, and 10. Spindle drive shaft 20 rotates freely on bearing **81*b* of upper housing portion 81 and bearing 92*b* of bottom cap 92. Referring to FIG. 10, spindle drive shaft 20 comprises a first spindle drive shaft section 21, a spline spindle drive shaft section 20*p*, a shoulder spindle drive shaft section 20*s*, a second spindle drive shaft section 23, a third spindle drive shaft section 25, and a fourth spindle drive shaft section 27. As shown in FIG. 2, spindle drive shaft 20 passes upwardly through bearing 92*b* in cap 92, through cylindrical space 98 of lower housing portion 85, through a drive roller 104 and an idler roller, indicated generally as 102, both of drive assembly 100, through waste thread spool 50, cylinder 30, base plate 130, and top bearing housing 10. Referring to FIGS. 2 and 10, spindle drive shaft 20 has a central axial bore 22, which extends through the entire length of spindle drive shaft 20. Axial bore 22 opens at the top end of spindle drive shaft 20 in an upper spindle drive shaft thread orifice 26, and at the bottom end of spindle drive shaft 20 in a lower spindle drive shaft thread orifice 24. A radial thread bore 28 is disposed in fourth spindle drive shaft section 27, which is the upper end portion of shaft 20, and which passes through cylinder 30. As depicted in FIGS. 2 and 4, radial thread bore 28 extends diagonally radially outward in a V-shape through fourth spindle drive shaft section 27 from axial bore 22 to a radial spindle drive shaft thread orifice 29 at the outer surface of fourth spindle drive shaft section 27**.

A separating portion (not shown) of spindle drive shaft 20, disposed within radial thread bore 28, serves to divide axial bore 22 into non-communicating upper and lower portions. As a result, spindle 1 may be threaded either from the top (through upper spindle drive shaft thread orifice 26) or the bottom (through lower spindle drive shaft thread orifice 24). The thread then passes through radial thread bore 28, and the separating portion (not shown) directs the yarn out through radial spindle drive shaft thread orifice 29.

Spindle drive shaft 20 may preferably be plated or formed from a wear resistant material such as chrome.

Figure 3:
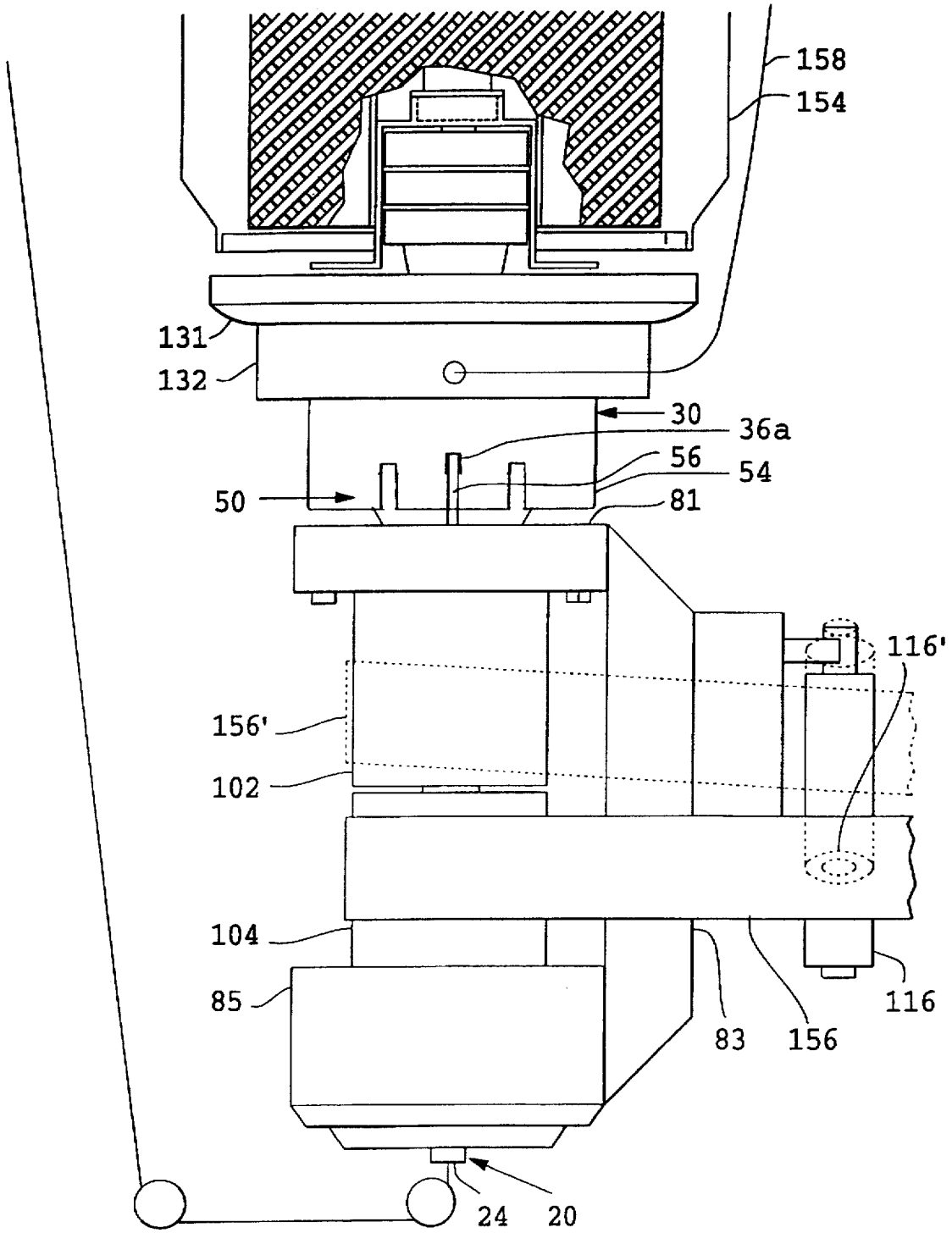
FIG. 3 is an orthographic side view with a yarn package break-away of the yarn spindle as depicted in FIG. 2.

Spindle 1 is powered by drive assembly 100, as shown in FIGS. 2 through 3. Drive belt 156 provides driving power through drive assembly 100 to spindle 1. Drive assembly 100 affords use of both a "drive" and a "neutral" gear. As illustrated in FIGS. 2 and 3, drive assembly 100 comprises idler roller 102, drive roller 104, and shifting assembly 110.

As shown in FIG. 2, drive roller 104 is mounted on spindle drive shaft 20. Drive roller 104 is attached to spindle drive shaft 20 by a set screw (not shown). Drive roller 104 has a central axial bore 106. A spring assembly, indicated generally as 104*s*, urges drive roller 104 upward in place against shoulder spindle drive shaft section 20*s* on spindle drive shaft 20. Spline spindle drive shaft section 20*p* mates in a driving relationship with corresponding splines 106*p* (shown in FIG. 5) on the inner surface of axial bore 106. Drive belt 156 passes around drive roller 104, as shown in FIG. 2. As a result, when drive roller 104 is driven by drive belt 156 or the like, spindle drive shaft 20 is powered.

While drive roller 104 provides a driving gear, idler roller 102 allows spindle 1 to be run in a neutral gear. Idler roller 102 comprises idler roller housing 103 and bearing 102*b*, and is positioned above drive roller 104 on spindle drive shaft 20. Bearing 102*b* comprises a standard 6002 bearing, and allows free rotation of idler roller 102 with respect to spindle drive shaft 20. When idler roller 102 is driven by drive belt 156, as shown in FIG. 7B, idler roller 102 rotates independently of drive roller 104 without engaging spindle drive shaft 20, thus providing a neutral gear.

Figure 7A:
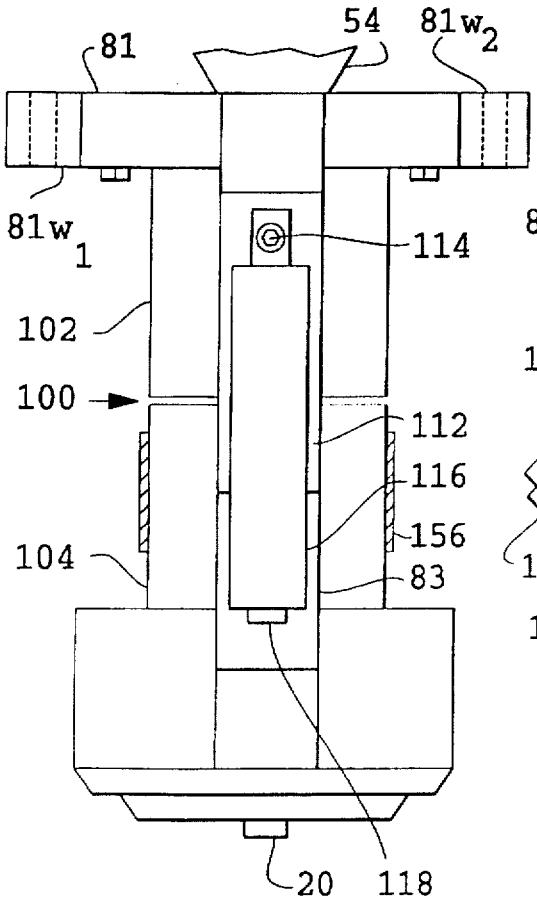
FIG. 7A is an orthographic front view of the bottom portion of the yarn spindle as depicted in FIG. 2 which includes a section of the drive belt and the shifting assembly.

To shift driving belt 156 back and forth between drive roller 104 to idler roller 102, shifting assembly 110 is provided. Shifting assembly 110, as depicted in FIGS. 2, 7A, and 7B, comprises shifting roll bracket 112, shifting roll joint 114, shifting roll 116, and shifting roll axle 118. Shifting roll bracket 112 is bolted to the side of central connector portion 83. Shifting roll axle 118 is rotatably connected to shifting roll bracket 112 via shifting roll joint 114. Shifting roll 116 is rotatably mounted on shifting roll axle 118 by bearings or the like.

Figure 7B:
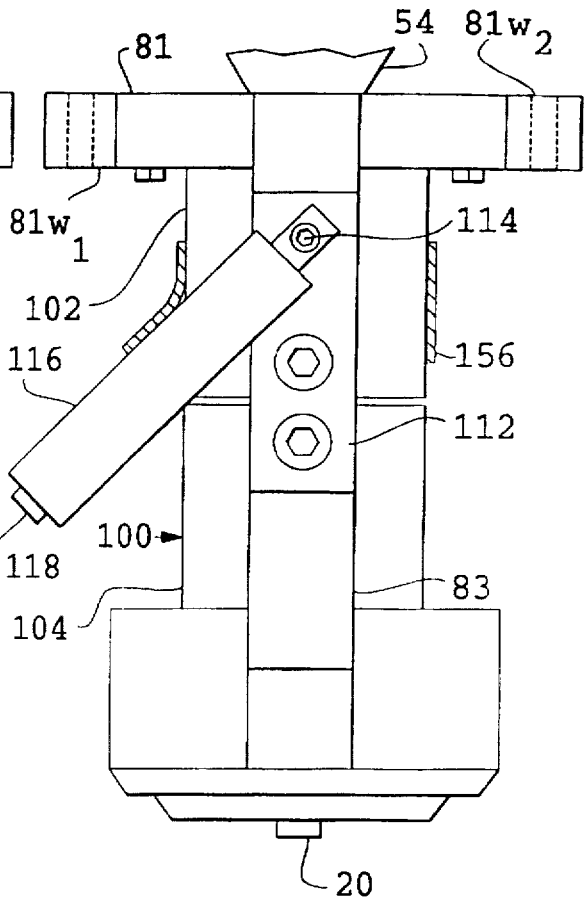
FIG. 7B is an orthographic front view of the bottom portion of the yarn spindle as depicted in FIG. 2 which includes a section of the drive belt and the shifting assembly, with the drive belt displaced by the shifting assembly.

The operation of shifting assembly 110 is depicted in FIGS. 7A and 7B. Referring to FIG. 7A, drive belt 156 passes around drive roller 104. As a result, drive roller 104 is driven by the movement of drive belt 156, causing spindle drive shaft 20 and cylinder 30 (not shown) to rotate. If shifting roll axle 118 is rotated about shifting roll joint 114, then shifting roll 116 abuts against drive belt 156, and is rotated thereby. If shifting roll axle 118 is rotated sufficiently upward (or clockwise), as depicted in FIG. 7B, then drive belt 156 is pushed off drive roller 104 and onto idler roller 102. The displaced drive belt and shifting roll are depicted (with dotted lines) in FIG. 3 as 156' and 116', respectively. At this point, idler roller 102 is driven, and rotates freely on bearing 102*b*, which is described above and shown in FIG. 2. As a result, drive roller 104, and thus spindle drive shaft 20 and cylinder 30, are no longer driven by drive belt 156. As shifting assembly 110 pushes drive belt 156 up from drive roller 104 to idler roller 102, at the same time a brake mechanism (not shown) is applied to halt the rotation of drive roller 104 (and thus spindle drive shaft 20 and cylinder 30). The brake mechanism comprises, for example, an external brake pad (not shown), which is urged against the rotating surface of drive roller 104. The brake mechanism is mechanically coupled to shifting assembly 110. This allows the operator to shift the drive belt 156 from drive roller 104 to idler roller 102, while in the same motion braking the drive roller 104 with the external brake pad, for example. Because shifting assembly 110 is external to drive roller 104 and idler roller 102, shifting assembly 110 can be separately serviced, without disassembling spindle drive shaft 20 from spindle housing 80. In addition, the external design of shifting assembly 100 simplifies the internal construction of the spindle 1, and avoids contamination of the spindle drive shaft bearings, a problem which may lessen the performance of clutch cone shifting assemblies. In particular, clutch cone shifting assemblies may suffer degradation of the fabric clutch pad due to friction, potentially resulting in crumbling of the pad material, and fouling of the bearings located below the clutch cone. The external shifting assembly is designed so as to avoid these problems.

Figure 11:
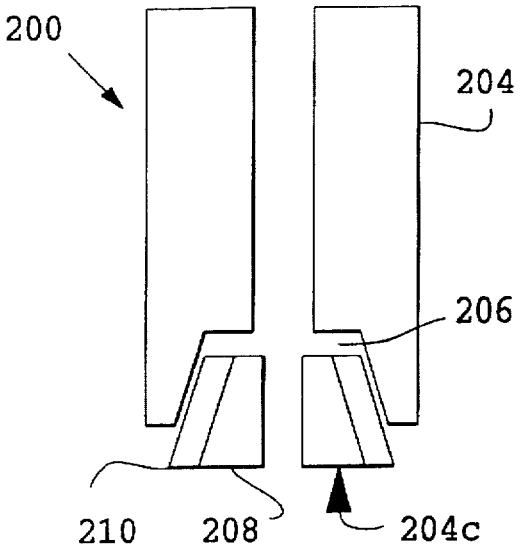
PRIOR ART Fig. 11
FIG. 11 is a cross-sectional orthographic view of a prior art clutch driving assembly.

As an alternative to the use of drive assembly 100, which features the external shifting assembly 110, prior art drive assembly 200 (shown in FIG. 11) may instead be employed for driving spindle 1. Drive assembly 200 also provides use of drive and neutral gears, but instead features an internal clutch, rather than an external shifting assembly. Drive assembly 200 is mounted on spindle drive shaft 20 on the portion of spindle drive shaft 20 between upper housing portion 81 and lower housing portion 85 (in the general position where drive roller 104 and idler roller 102 are disposed in drive assembly 100). Referring now to FIG. 11, drive assembly 200 comprises drive roller 204 and a clutch 204*c*. Drive assembly 200 is powered by drive belt 156, which passes about drive roller 204 in a manner not shown in FIG. 11. Drive roller 204 comprises a housing 204*h*, and two bearings (not shown). The two bearings allow drive roller 204 to freely rotate with respect to spindle drive shaft 20. Drive roller 204 further has a frusto-conical cavity 206 opening to the bottom side of drive roller 204. Clutch 204*c* comprises a frusto-conical clutch cone 208 which fits into cavity 206. A replaceable clutch pad 210 is glued to clutch cone 208, so clutch 204*c* may be pushed into cavity 206 to achieve a frictional driving relationship. Clutch cone 208 has a central axial bore with splines (not shown) that mate with spline spindle drive shaft section 20*p*. The mating of these respective splines places clutch 204*c* and spindle drive shaft 20 in a driving relationship. Clutch 204*c* may be selectively axially moved by an adjustment lever or the like (not shown) so as to engage or disengage the interior surface of cavity 206 of drive roller 204. Drive assembly 200 thus allows shifting between drive and neutral gears via clutch 204*c*. Once the clutch 204*c* is out of driving engagement with drive roller 204, a brake mechanism such as the above-described external brake pad may be applied to halt rotation of the drive roller 204 (and thus the spindle drive shaft 20). Preferably, the brake mechanism is coupled to the adjustment lever or the like to afford the operator the opportunity to both shift and brake the spindle in one motion.

Figure 19:
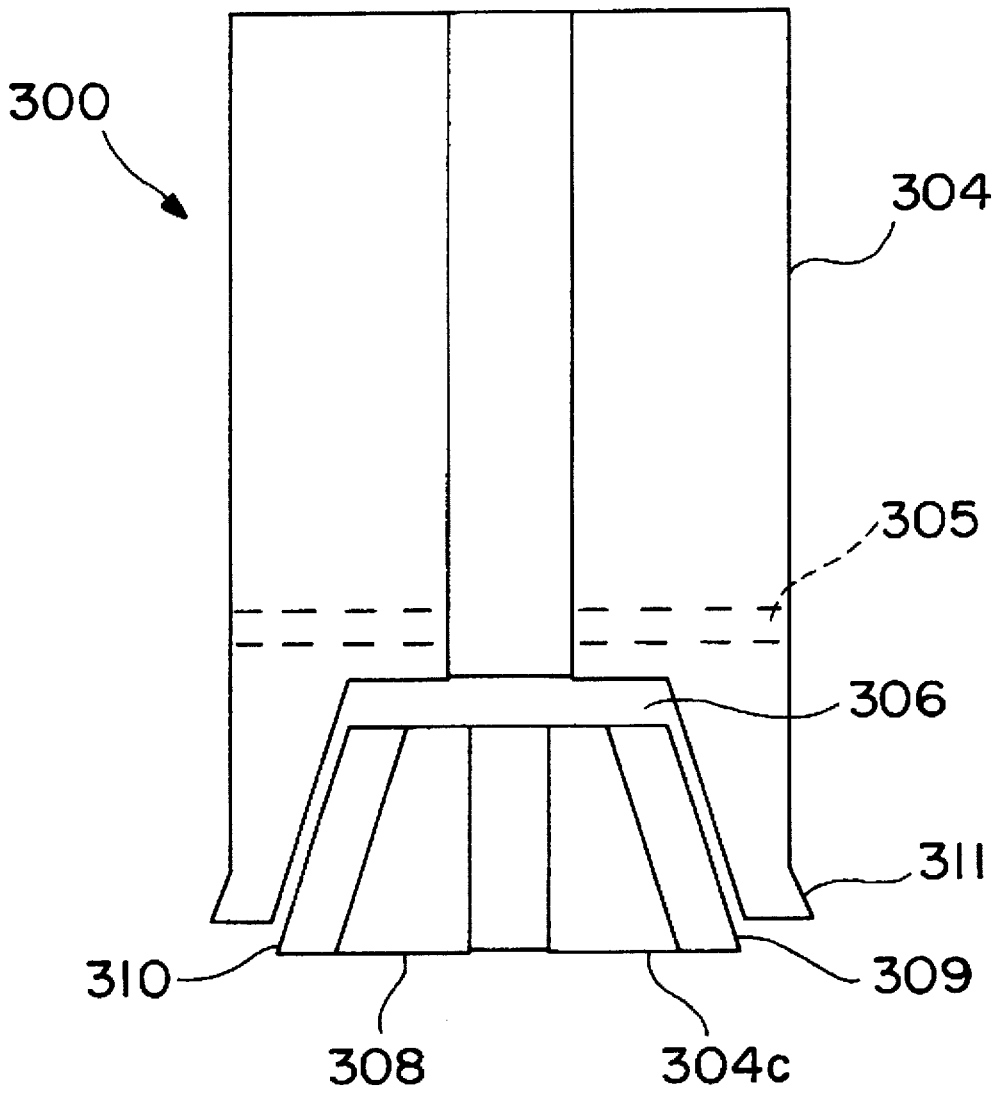
FIG. 19 is a cross-sectional orthographic view of another embodiment of a clutch driving assembly.

Alternatively, a preferred embodiment may incorporate a drive assembly 300 as illustrated in FIG. 19. Drive assembly 300 is powered by a drive belt passing about drive roller 304 in a manner not illustrated in FIG. 19, and is mounted on spindle drive shaft 20 in a manner similar to mounting of drive assembly 200.

Drive assembly 300 includes a clutch 304*c* and a drive roller 304. Clutch 304*c* includes a frusto-conical clutch cone 308 having a longer and a less vertical side wall 309 in comparison to previously discussed clutch cone 208 of clutch 204*c*. A replaceable clutch pad 310 is affixed to sidewall 309 to provide frictional contact with a surface space of cavity 306 of drive roller 304. Cavity 306 is dimensioned complementary to clutch cone 308.

Clutch cone 308 also has a central axial bore with splines (not shown) meeting with spline spindle drive shaft section 20*p* placing clutch 304*c* and spindle drive shaft 20 in a driving relationship. Clutch 304c may be selectively axially moved by an adjustment lever or functionally equivalent structure (not shown) in order to engage or disengage clutch cone 308 and drive roller 304.

Drive roller 304 includes a housing and two bearings (not shown). Drive roller 304 further includes a number of transverse vent holes 305 for facilitating heat transfer away from drive assembly 300. Vent holes 305 are positioned near cavity 306 and pass transversely through drive roller 304.

The longer and less vertical side wall 309 of clutch cone 308, in comparison to comparable elements of drive assembly 200, yield improved frictional contact between the surface of clutch cone 308 and the surface of cavity 306. Additionally, a bottom end of drive roller 304 includes a flared portion 311. Flared portion 311 further increases the surface area of cavity 306 in comparison to the surface area of cavity 206 of assembly 200. Frictional contact between the surface of clutch cone 308 and the surface of cavity 306 is thereby increased. The increased frictional contact results in an increased driving efficiency in comparison to drive assembly 200.

Finally, when clutch 304c is out of driving engagement with drive roller 304, a brake mechanism such as the above-described external brake pad may be applied to halt rotation of drive roller 304 thereby halting rotation of spindle drive shaft 20. Preferably, the brake mechanism is coupled to the adjustment lever or functionally equivalent structure thereby affording the operator an opportunity to both shift and brake spindle 1 in one motion.

Whether drive assembly 100, drive assembly 200 or drive assembly 300 is employed, spindle drive shaft 20 passes upward through spindle housing 80, and through a waste thread spool 50. As depicted in FIGS. 2, 5, 6A, and 6B, waste thread spool 50 comprises a disk-shaped base 52 that is integral with an inverted frusto-conical barrel portion 54, both stationary. The top surface of base 52 is preferably flush with the top surface of lip 90. Base 52 and barrel portion 54 may be machined together as one seamless unit. As shown in FIG. 2, barrel portion 54 is disposed atop base 52, with the upper surface 60 of barrel portion 54 (i.e., the base of the frustum) facing upwards. The outer side surface (outer wall) 61 of barrel portion 54 forms an angle of about 32 degrees with base 52. Waste thread spool 50 has a central axial bore 58, through which passes a portion of spindle drive shaft 20, namely third spindle drive shaft section 25, with a clearance of about 0.010 to 0.050 inches, preferably about 0.032 inch. Such clearance affords free rotation of spindle drive shaft 20 as it passes through waste thread spool 50. Base 52 fits into the cylindrical space defined by circumferential lip 90 of upper housing portion 81 as described above, and has fitting holes 62a and 62b. Bolts 94a and 94b pass upwards through upper housing portion 81 and through fitting holes 62a and 62b, respectively, to bolt thread spool 50 to upper housing portion 81.

In an alternative embodiment, barrel portion 54 may be configured with a vertical, rather than an inclined, outer wall.

Additionally, waste thread spool 50 and upper housing portion 81 may be formed as one integral and solid unit. Bolts 94a and 94b and fitting holes 62a and 62b are thereby eliminated. Bearing 81b may then be positioned within barrel portion 54 between base 52 and upper surface 60. Bearing 81b is thus located closer to a load acting on the top end of spindle drive shaft 20.

By way of illustration but not limitation, bearing 81b may be lubricated, rubber sealed, double-ball bearings. The lubrication may be provided by a high melting temperature lubricant such as Kendall Super Blue High Temperature E.P., L-427 grease.

Figure 20:
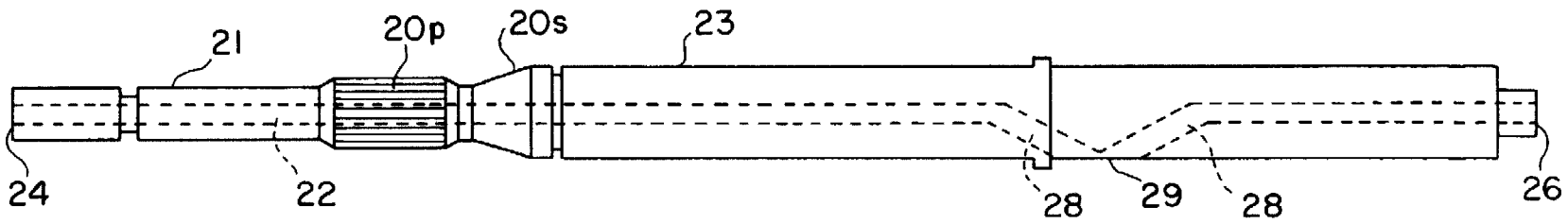
FIG. 20 is an orthographic detailed view of an alternative spindle drive shaft embodiment.

Pursuant to the above-described alternative embodiment, second spindle drive shaft section 23 of spindle drive shaft 20 would be configured complementary to the position of bearing 81b, as illustrated in FIG. 20.

Barrel portion 54 has a waste yarn removal slot 56, which is machined into or formed on the inclined side surface 61 at a circumferential position generally facing toward central connector portion 83. Waste yarn removal slot 56 extends along side surface 61 from the intersection of barrel portion 54 and base 52 to the top edge of barrel portion 54. Waste yarn removal slot 56 is approximately 3/16 inch wide and 1/8 inch deep.

Figure 6A:
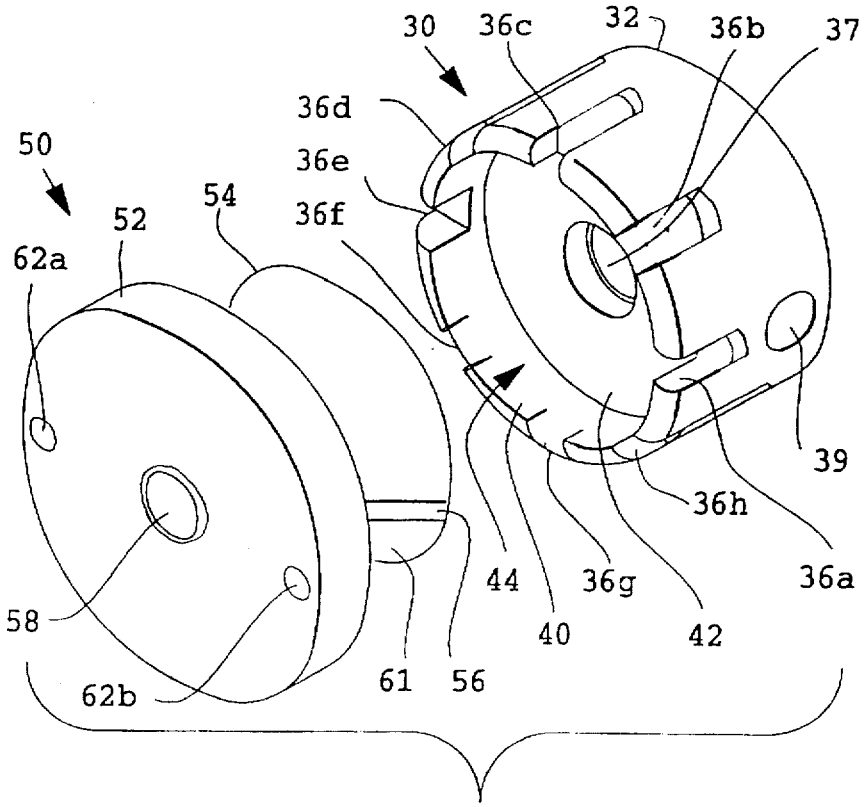
FIG. 6A is an isometric exploded close-up view with an underside point of view of the cylinder and the thread spool of the yarn spindle as depicted in FIG. 2.
Figure 6B:
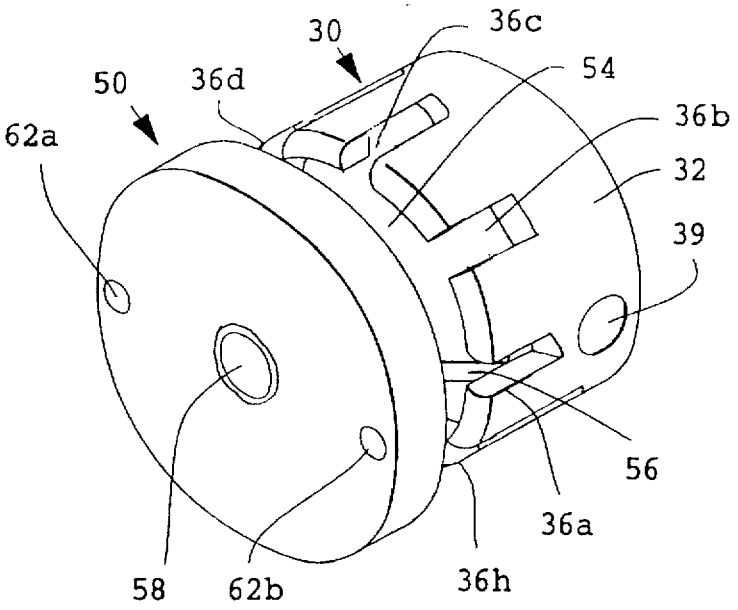
FIG. 6B is an isometric close-up view with an underside point of view of the cylinder and the waste thread spool of the yarn spindle as depicted in FIG. 2.

Mounted on spindle drive shaft 20 above waste thread spool 50 is cylinder 30, as depicted in FIGS. 2, 6A, and 6B. Cylinder 30 comprises a cylindrical disk 32 having a bottom surface 42 and a downwardly extending skirt 40. The bottom edge of skirt 40 is generally rounded in form. Cylindrical disk 32 has a radius, for example, of about 1.350 inches to 1.400 inches, most preferably 1.375 inches. Skirt 40 extends downward to overhang the bottom surface 42 of cylindrical disk 32 by about 0.415 inch to 0.435 inch.

Cylinder 30 is fixedly attached to and thus rotates along with spindle drive shaft 20. Cylinder 30 has a central axial bore 37 through which spindle drive shaft 20 extends. As illustrated in FIG. 2, cylinder 30 is mounted on spindle drive shaft 20 in the vicinity of fourth spindle drive shaft section 27. Spindle drive shaft 20 mates in a driving relationship with the interior surface of axial bore 37. For example, a press fit engagement with a set screw (not shown) is employed to tightly seat cylinder 30 on spindle drive shaft 20. Such a tight coupling reduces potential vibration of the cylinder 30 as it rotates at speeds of 6500 rpm, for example.

Cylindrical disk 32 also has a cylinder thread bore 38, which extends radially outward from axial bore 37 to a cylinder thread orifice 39 at the side surface of cylindrical disk 32. Cylinder thread bore 38 communicates with the spindle drive shaft thread orifice 29.

Cylinder 30 further includes a corresponding counterweight bore (not shown) located in the side surface of cylindrical disk 32 at a position radially opposite to the position of cylinder thread bore 38 so as to balance the cylinder 30.

As shown in FIGS. 6A and 6B, disposed at approximately equal intervals along the bottom edge of the skirt 40 are eight thread cutting slots 36a, 36b, 36c, 36d, 36e, 36f, 36g and 36h of generally crenelated form. The slots each pass entirely through skirt 40. Thread cutting slot 36a is disposed below cylinder thread orifice 39. Thread cutting slots 36b, 36c, 36d, 36f, 36g, and 36h are all approximately 3/16 inch in depth and approximately 3/16 inch in width. Thread cutting slots 36a and 36e are disposed approximately 180 degrees apart around the circumference of skirt 40. For example, thread cutting slot 36e may be disposed below the counterweight bore described above (not shown). Thread cutting slots 36a and 36e are both approximately 7/16 inch deep and approximately 1/8 inch in width. The increased width of slots 36a and 36e affords the operator easier access to waste yarn removal slot 56.

Cylinder 30 also has a circumferential rim 46 disposed at the top surface of cylindrical disk 32. Located on rim 46 is a positioning post 48 for connection with a corresponding hole 130h on base plate 130.

Cylinder 30 and waste thread spool 50 are arranged to resist entry of broken yarn threads. In particular, as described above, barrel portion 54 extends upward, underneath skirt 40, and into cylindrical space 44. Barrel portion 54 is separated from cylinder 30 by an axial gap 68*a* and a radial gap 68*r*. Axial gap 68*a* is located between the lower surface 42 of cylindrical disk 32 and the upper surface 60 of waste thread spool 50. Radial gap 68*r* is located between the inner surface of skirt 40 and the circumferential edge of top surface 60. Axial gap 68*a* and radial gap 68*r* afford free rotation of cylinder 30 with respect to stationary thread spool 50, whilst offering only small clearances into which wayward yarn fragments may enter. In particular, cylinder 30, spindle drive shaft 20, and thread spool 50 are arranged such that axial gap 68*a* is approximately 0.015 inch wide. Radial gap 68*r* is approximately 0.010 to 0.020 inch wide, preferably approximately 0.015 inch wide.

In addition, skirt 40 extends downward, below bottom surface 42 of cylindrical disk 32 by about 0.415 inch to 0.435 inch, and overhangs top surface 60 of thread spool 50 by about 0.400 inch to 0.420 inch. The greater the overhang of skirt 40, the more protection is afforded to sensitive axial gap 68*a* and radial gap 68*r*. Such an overhang lessens the chance of yarn fragments entering axial gap 68*a* and radial gap 68*r* by providing a longer and more tortuous path thereto. Entrance of yarn into axial gap 68*a* or radial gap 68*r* could jam spindle drive shaft 20 and/or cylinder 30, thus causing damage to spindle 1. However, as cylinder 30 may attain speeds of 6500 rpm, it is advantageous to minimize the weight of cylinder 30 so as to reduce power requirements and the like. Accordingly, by keeping the length of skirt 40 to the minimum required to block yarn fragments from entering axial gap 68*a* and radial gap 68*r*, the weight of cylinder 30 may be kept to a minimum.

Top bearing housing 10, as depicted in FIGS. 2 and 3, comprises housing 12, upper bearing 11$b_1$, and lower bearing 11$b_2$. Upper bearing 11$b_1$ comprises a 6002 bearing, and lower bearing 11$b_2$ comprises a 5202 bearing. Housing 12 comprises two circumferentially located rubber O-rings 12$r_1$ and 12$r_2$. Housing 12 is rotatably mounted by upper bearing 11$b_1$ and lower bearing 11$b_2$ on an upper portion of spindle drive shaft 20, namely fourth spindle drive shaft section 27, and accordingly is free to rotate relative to spindle drive shaft 20. Top bearing housing 10 may thus be held stationary while spindle drive shaft 20 rotates. Fourth spindle drive shaft section 27 of spindle drive shaft 20 extends upward from cylinder 30, and through a central bore 14 in top bearing housing 10. As a result, spindle drive shaft 20 protrudes upward through the top of top bearing housing 10, thus affording access to upper spindle drive shaft thread orifice 26.

Directly below top bearing housing 10, a sleeve 77 is fixedly seated on fourth shaft section 27. Sleeve 77 is of generally cylindrical form, with an indented waist portion.

Referring now to FIGS. 2 and 3, in operation, spindle 1 is used with base plate 130, yarn package 152, and pot 154. Before beginning operation, the base plate 130 is attached to the top surface of cylinder 30. As shown in FIGS. 2 through 4, base plate 130 comprises an upper bowl-shaped portion 131 and a downwardly protruding annular lip 132. Base plate 130 has a central bore of sufficient diameter that base plate 130 may be slipped down past top bearing housing 10 to rest on rim 46 of cylinder 30. Base plate 130 has a bore 130*h* located on its bottom surface, into which positioning post 48 fits. Once base plate 130 has been lowered into position on top of cylinder 30, two screws (not shown) are tightened into corresponding screw holes 46*h* (shown in FIG. 6C) on rim 46 of cylinder 30 to firmly seat base plate 130 thereon. Base plate 130 rotates along with cylinder 30. Passing through lip 132 is a base plate thread bore 138, which extends radially outward to base plate thread orifice 139 at the surface of lip 132. Base plate thread bore 138 is arranged to be substantially coaxial with cylinder thread bore 38, and communicates with cylinder thread orifice 39. FIGS. 2 and 3 depict the mounting of base plate 130 on cylinder 30.

While strand or thread 158 is depicted in FIG. 2 as passing freely past the edge of base plate 130, and up past pot 154, it should be noted that a standard size pot 154 actually has a larger relative diameter than depicted in FIG. 2. As a result, the inclined corner of pot 154 is often (if not usually) in frictional contact with thread 158. Accordingly (although not depicted in the drawings), the diameter of base plate 130 may be lengthened by, say, as much as ⅓, e.g. from 9 to 12 inches. In that case lip 132 would also be proportionally radially extended, so that base plate thread orifice 139 is disposed radially outwards, by about 2 inches, for example, so as to extend beyond, or nearly beyond, pot 154. As a result, the bottom sector of the yarn balloon will be horizontally displaced away from the edge of pot 154, and the yarn will rise more nearly vertically from orifice 139. Such an arrangement can avoid frictional engagement of thread 158 with the bottom corners of pot 154.

Once base plate 130 is in place, the pot 154, which contains the yarn package 152, is mounted on the spindle 1, as shown in FIG. 2. Top bearing housing 10 supports the yarn package 152 and the pot 154. Pot 154 is firmly seated on top bearing housing 10 via frictional contact between O-rings 12$r_1$ and 12$r_2$, and pot cup 154*c*. Threaded cast iron plate 155 is screwed down onto pot cup 154*c* and rests on the bottom inside surface of pot 154 to provide weight for pot stabilization. Two-for-one attachment 154*d* screws into the top of pot cup 154*c* and communicates with top spindle drive shaft thread orifice 26 to provide an avenue for two-for-one twisting. An 18 gauge metal disc, for adding support to the bottom of pot 154, and a rubber washer (both not shown), are disposed between the exterior bottom surface of pot 154 and the radially-projecting lip of pot cup 154*c*. Yarn package 152 is disposed in pot 154 atop pot cup 154*c*. Yarn package 152 and pot 154 are held stationary on top bearing housing 10 by means of magnetic stabilization or the like. As a result, yarn package 152, pot 154, and top bearing housing 10 all remain substantially stationary whilst spindle drive shaft 20 is driven by drive assembly 100.

Figure 12:
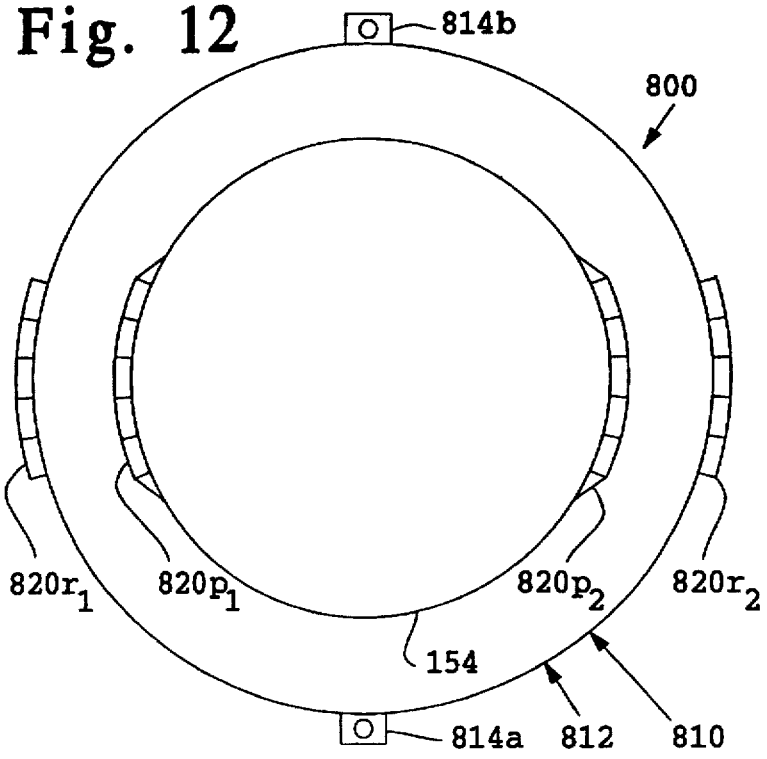
FIG. 12 is a cross-sectional orthographic top view of a magnetic stabilizer.
Figure 13:
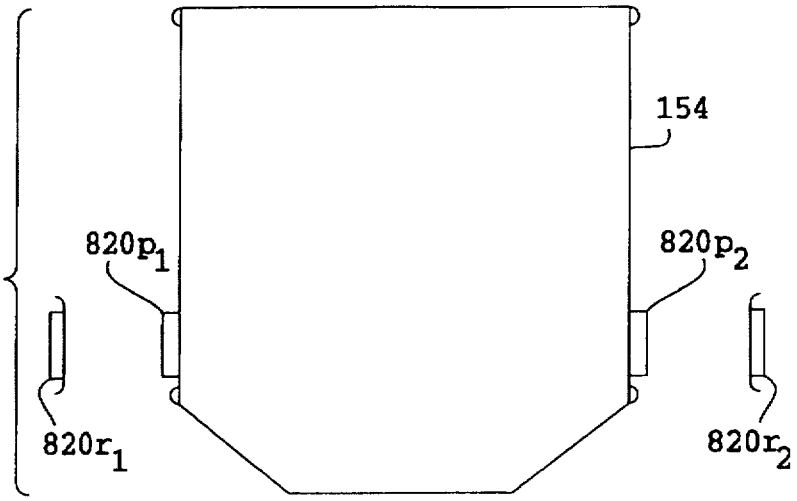
FIG. 13 is a cross-sectional orthographic side view of the magnetic stabilizer of FIG. 12.

In a preferred embodiment, referring now to FIGS. 12 and 13, a magnetic stabilizer, indicated generally as 800, is employed to hold pot 154 stationary. Magnetic stabilizer 800 is used in combination with a balloon control ring 810. Balloon control ring 810 comprises an annular guide 812 with attachment wings 814*a* and 814*b* disposed on opposite sides of guide 812. Via a mounting bracket (not shown), the attachment wings 814*a* and 814*b* of balloon control ring 810 are attached to respective mounting wings 81$w_1$ and 81$w_2$ (shown in FIGS. 4, 5, 7A, and 7B) of the spindle housing 80. Balloon control ring 810 is disposed around the pet 154 and effectively controls the size and shape of the balloon formed by the revolving strand (not shown).

Figure 14:
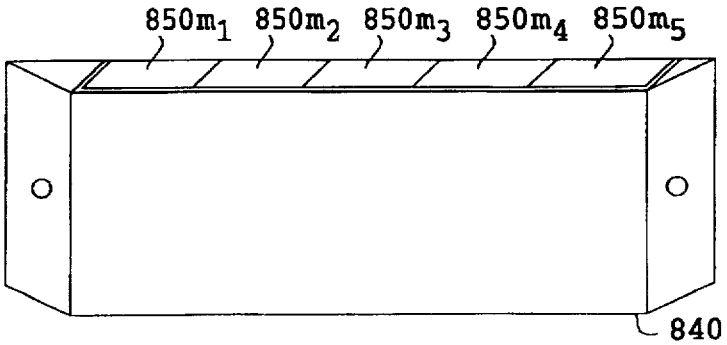
FIG. 14 is a cross-sectional orthographic side view of the magnet sleeve used in the magnetic stabilizer of FIG. 12.

Magnetic stabilizer 800 comprises two pairs of magnet pockets: pot magnet pockets 820$p_1$ and 820$p_2$, and ring magnet pockets 820$r_1$ and 820$r_2$. Pot magnet pockets 820$p_1$ and 820$p_2$ are mounted on opposite sides of the bottom of the exterior side surface of pot 154. Ring magnet pockets 820$r_1$ and 820$r_2$, separated by a gap from pot magnet pockets 820$p_1$ and 820$p_2$, respectively, are mounted, on the outside circumferential surface of balloon control ring 810. Each of the four magnet pockets (820$p_1$, 820$p_2$, 820$r_1$, and $820r_1$) comprises a magnet sleeve 840, which holds, disposed side by side, five ceramic magnets $850m_1$ through $850m_5$, each 1¼ inches wide, 2⅛ inches long, and ⅜ inch thick as depicted in FIG. 14. This construction is not limited to use of five magnets; for example four magnets may be employed. The magnets $850m_1$ through $850m_5$ are arranged with alternating polarity, e.g. N/S/N/S/N. The magnets in pot magnet pocket $820p_1$ and ring magnet pocket $820r_1$ are arranged with opposite polarity (e.g. N/S/N/S/N and S/N/S/N/S, respectively). The magnets in pot magnet pocket $820p_2$ and ring magnet pocket $820r_2$ are also arranged with opposite polarity. As a result, the magnets of the opposing pot and ring magnet pockets are attracted to each other. Thus, pot 154 is magnetically urged to remain stationary with respect to balloon control ring 810.

Figure 8:
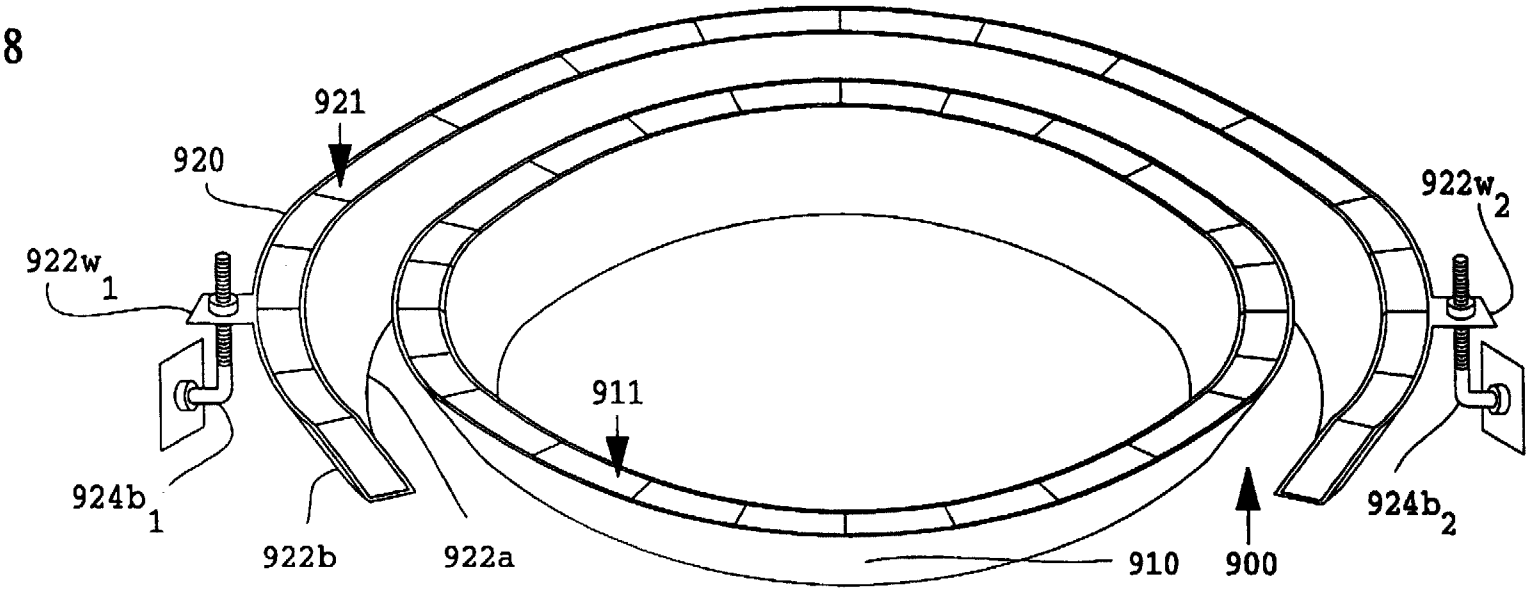
FIG. 8 is an isometric view of the external magnet bracket and internal magnet pocket of a magnetic stabilizer for use with the yarn spindle as depicted in FIG. 2.
Figure 9:
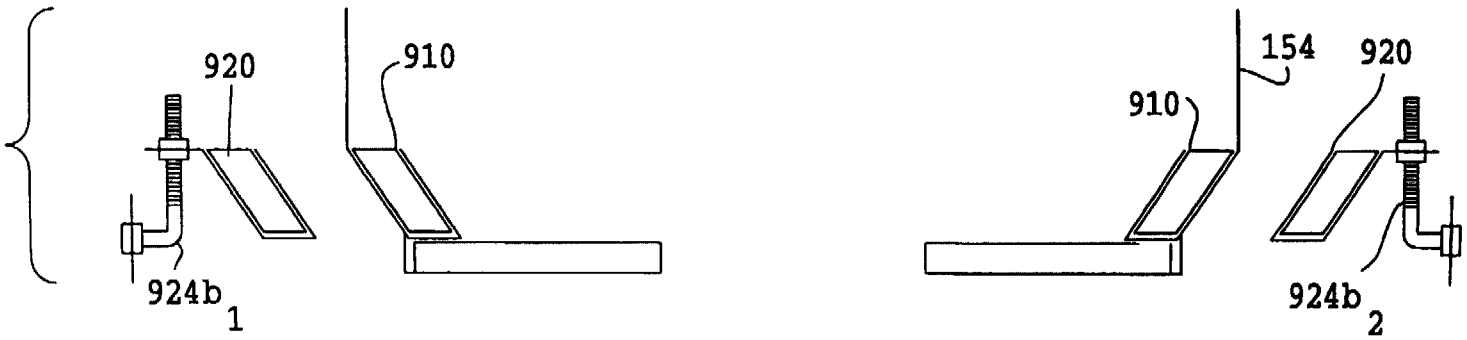
FIG. 9 is a cross-sectional orthographic side view of the magnetic stabilizer of FIG. 8.

As an alternative, when the balloon control ring is not used, a magnetic stabilizer indicated generally as 900 in FIGS. 8 and 9 may be employed. The balloon control ring might be removed to reduce tension on the strand, for example. Magnetic stabilizer 900 comprises an internal magnet pocket 910 and an external magnet bracket 920, as shown in FIG. 8. Internal magnet pocket 910 is seated in the bottom of pot 154, and is made of 18 gauge aluminum. As shown in FIG. 8, internal magnet pocket 910 comprises a hollow annulus with a generally U-shaped cross section and an open top. The opposing side walls of internal magnet pocket 910 are parallel and inclined from the vertical by approximately 30 degrees. The opening at the top of internal magnet pocket 910 is 0.5 inch in width, and the outer circumferential diameter is 8.5 inches. The exterior side surface of internal magnet pocket 910 fits against the correspondingly inclined lower side wall of pot 154, at the bottom of pot 154 as shown in FIG. 9. The hollow annular space of internal magnet pocket 910 is filled with magnets, indicated generally by 911, each of which is 15/16 inches by 2⅛ inches by 11/32 inch in size. The magnets 911 are slipped into the internal magnet pocket 910 through the open top, and are placed side-by-side around the entire circumference of internal magnet pocket 910. The magnets 911 are arranged with alternating polarity, e.g. N/S/N/S/N/etc.

Referring again to FIG. 8, external magnet bracket 920 comprises a truncated hollow annulus of generally the same inclined U-shaped construction as internal magnet pocket 910, but covering only 60% of the 360 degree span. Because external magnet bracket 920 covers only 60% of a circle, it affords the operator easy access to the spindle 1, and in particular to waste thread spool 50. However, this is not limiting, and a full 360 degree circle may be employed alternatively. External magnet bracket 920 is constructed of 18 gauge aluminum. The interior and exterior side walls, **922*a* and 922*b*, are approximately ½ inch apart. Each wall is about 1⅞ inches in height and inclined about 30 degrees from the vertical. The interior wall 922*a* has a diameter of 10¾ inches at the bottom end, and a diameter of 11.94 inches at the top end. Located 180 degrees apart from each other at the outer circumferential edge of external magnet bracket 920 are mounting portions $922w_1$ and $922w_2$, each of which has a respective mounting hole $922h_1$ and $922h_2$ (not shown). As shown in FIGS. 8 and 9, by use of these mounting holes $922h_1$ and $922h_2$ (not shown) the external magnet bracket 920 is mounted on bolt assemblies $924b_1$ and $924b_2$, which are connected to the separator of the frame (not shown) upon which the spindle 1 is mounted. Referring again to FIG. 8, the top of external magnet bracket 920 is open for insertion of magnets, as described above with respect to internal magnet pocket 910. These magnets are indicated generally as 921. The magnets 921 are placed side-by-side, with alternating polarity, inside external magnet bracket 920, with the polarity arranged so as to attract the opposing magnets of the internal magnet pocket 910. Disposed at the two ends of the truncated arc of external magnet bracket 920 are yarn balloon flairs (not shown) angled outward so as to deflect the yarn balloon. Magnet stabilizer 900 serves to prevent pot 154 from moving during spindle operation, due to the attraction between the respective magnets of internal magnet pocket 910 and external magnet bracket 920**.

When the balloon control ring is not used, an alternative magnetic stabilizer may preferably be employed. In an alternative embodiment, the pot magnet pockets $820p_1$ and $820p_2$ may be employed in the manner discussed above. However, instead of placing ring magnet pockets $820r_1$ and $802r_2$ on a balloon control ring, these pockets may be placed on the frame separator.

Whether magnetic stabilizer 800 or 900 (FIGS. 12 and 8, respectively) or another stabilizer is employed, once base plate 130, pot 154, and yarn package 152 have been mounted as described above, spindle 1 may be used in either of two modes of operation: cabling or two-for-one twisting. In a cabling operation, as illustrated in FIGS. 2 and 3, yarn thread 158 originates from an overhead creel and enters spindle 1 via lower spindle drive shaft thread orifice 24. Yarn thread 158 then passes through the spindle 1 via axial bore 22 of spindle drive shaft 20, radial spindle drive shaft thread bore 28, cylinder thread bore 38, and base plate thread bore 138, and exits from base plate 130 at base plate thread orifice 139.

Yarn thread 158 then passes up around the pot 154, as depicted in FIGS. 2 and 3. As cylinder 30 rotates at high speed, yarn thread 158 forms a "balloon" of yarn around pot 154. A second yarn thread (not shown) is unwound from the yarn package 152, and the balloon of yarn thread 158 is twisted about the second yarn thread at a position above spindle 1, with the cabled combination being taken up on a take-up reel (not shown).

As mentioned, spindle 1 may also be used as a two-for-one twister (not shown). Yarn thread 158 could alternatively originate from yarn package 152 (instead of an overhead creel), and then enter (not shown) through upper spindle drive shaft thread orifice 26, passing downward through axial bore 22 of spindle drive shaft 20. After passing out through radial spindle drive shaft bore 28, and eventually exiting from base plate thread orifice 139 in the fashion described above, yarn thread 158 again forms a balloon around pot 154. The resultingly twisted yarn thread 158 may then be stored on a take-up reel overhead (not shown).

Figure 6C:
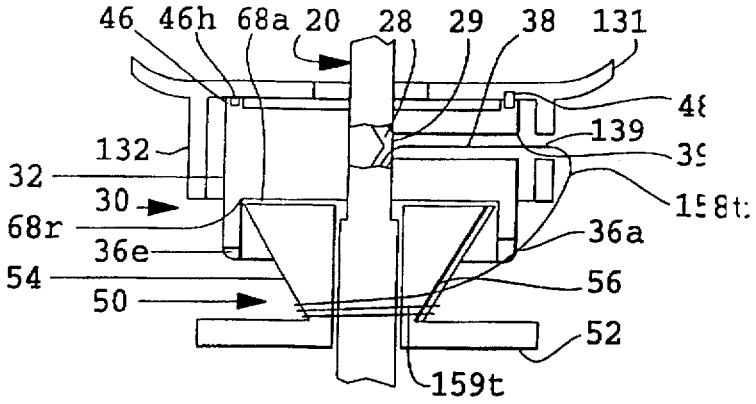
FIG. 6C is an orthographic break-away section close-up side view of the cylinder, the waste thread spool, and the spindle drive shaft of the yarn spindle as depicted in FIG. 2.

In either cabling or two-for-one twisting, the spindle 1 affords advantageous resistance against jamming when yarn thread 158 breaks. As illustrated in FIGS. 6C through 6F, if yarn thread 158 breaks outside base plate thread orifice 139, the loose tail **158*t* of yarn thread 158 will fall downwards and be whipped around by the rotation of cylinder 30 and base plate 130. As tail 158*t* continues to fall, it can make contact with waste thread spool 50. As a result, a waste yarn tail 159*t* can form, as the rotation of cylinder 30 and base plate 130 wraps yarn thread 158 around barrel portion 54, as depicted in FIG. 6C. As the rotation of cylinder 30 continues, yarn thread 158 continues to feed through the spindle 1 and out of base plate thread orifice 139. Yarn thread 158 wraps around spool 50, causing a tightly-wound waste yarn tail 159*t* to develop around spool 50. Because of its inverted frusto-conical design, barrel portion 54 tends to cause waste yarn tail 159*t* to accumulate and remain at the bottom portion thereof. As a result, waste yarn tail 159*t* and various yarn fragments are less likely to enter the above-described axial gap 68***a* and radial gap 68*r* and jam spindle 1.

Figure 6D:
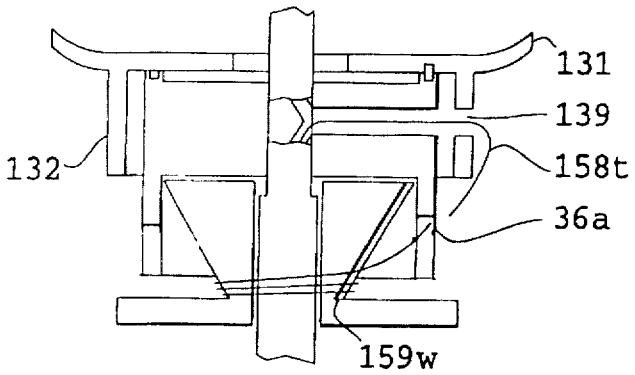
FIG. 6D is an orthographic break-away section close-up side view of the cylinder, the waste thread spool, and the spindle drive shaft of the yarn spindle as depicted in FIG. 2.

Either before or after tail 158*t* begins to wrap around waste thread spool 50, the thread cutting slots 36*a* through 36*h* of the cylinder 30 serve to shorten the revolving tail 158*t* by severing yarn thread 158. In particular, the rotation of cylinder 30 causes one or more of the thread cutting slots 36*a* through 36*h* to contact and sever the tail 158*t*. If the tail 158*t* had not yet begun to wrap around waste thread spool 50, then the severed tail falls downward as a loose waste yarn fragment. If instead the severed tail had already begun to wrap around waste thread spool 50, creating waste tail 159*t*, then the severing leaves a waste yarn fragment 159*w* wrapped around barrel portion 54. The latter case is illustrated in FIGS. 6C and 6D. In FIG. 6C, thread cutting slot 36*a*, for example, contacts tail 158*t* of yarn thread 158. The continued rotation of cylinder 30 causes one or more of the thread cutting slots, e.g. thread cutting slot 36*a*, to sever tail 158*t*, as shown in FIG. 6D, leaving behind a waste yarn fragment 159*w*. In either case, the severing considerably shortens the revolving tail 158*t*. As a result, the flailing tail 158*t* of yarn thread 158 has less mass; accordingly, there is less tendency for the yarn to be pulled out of the spindle 1 by centrifugal force. As a result, the continued feeding of yarn thread 158 usually ceases, and the corresponding increase in the length of tail 158*t* halts.

Figure 6E:
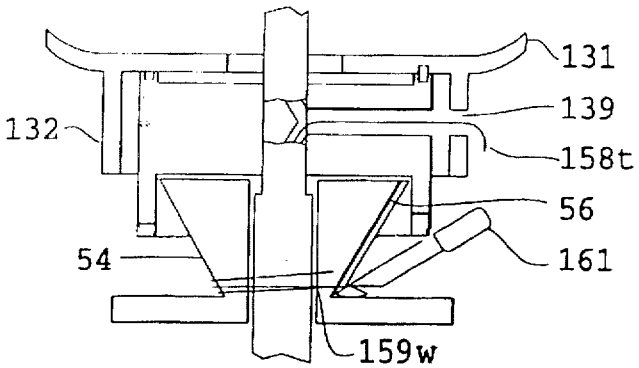
FIG. 6E is an orthographic break-away section close-up side view of the cylinder, the waste thread spool, and the spindle drive shaft of the yarn spindle as depicted in FIG. 2.
Figure 6F:
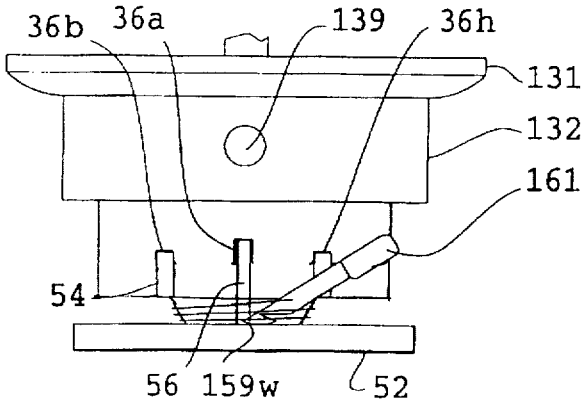
FIG. 6F is an orthographic close up front view of the cylinder, the thread spool and the spindle drive shaft of the yarn spindle as depicted in FIG. 2.
Figure 15:
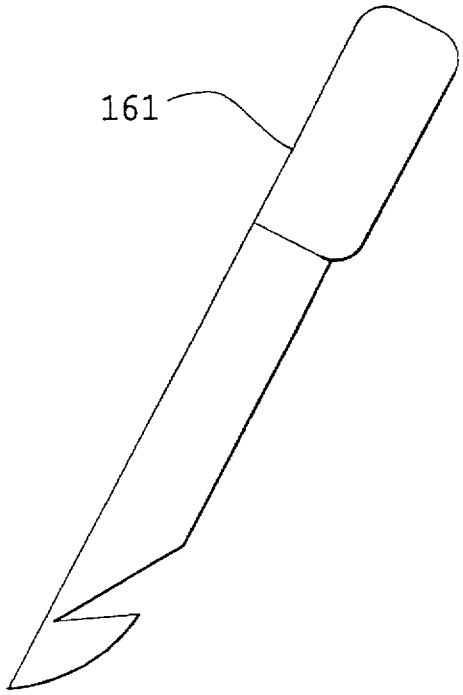
FIG. 15 is a side orthographic view of the hook knife for removing waste yarn.

Waste yarn fragment 159*w* may be removed from thread spool 50 by the technique shown in FIGS. 6E and 6F. The operator removes waste yarn fragment 159 when the cylinder 30 is not rotating. Guiding a hook knife 161 (also shown in FIG. 15) up and down through waste yarn removal slot 56, the operator can cut, hook, and pull off the accumulated waste yarn fragment 159*w*. The operator may manually rotate the cylinder 30 so that elongated thread cutting slot 36*a* (or 36*e*), for example, is aligned with waste yarn removal slot 56, as depicted in FIG. 6F. By doing so, the operator is afforded more advantageous access to waste yarn removal slot 56, which extends upward under skirt 40.

Figure 16:
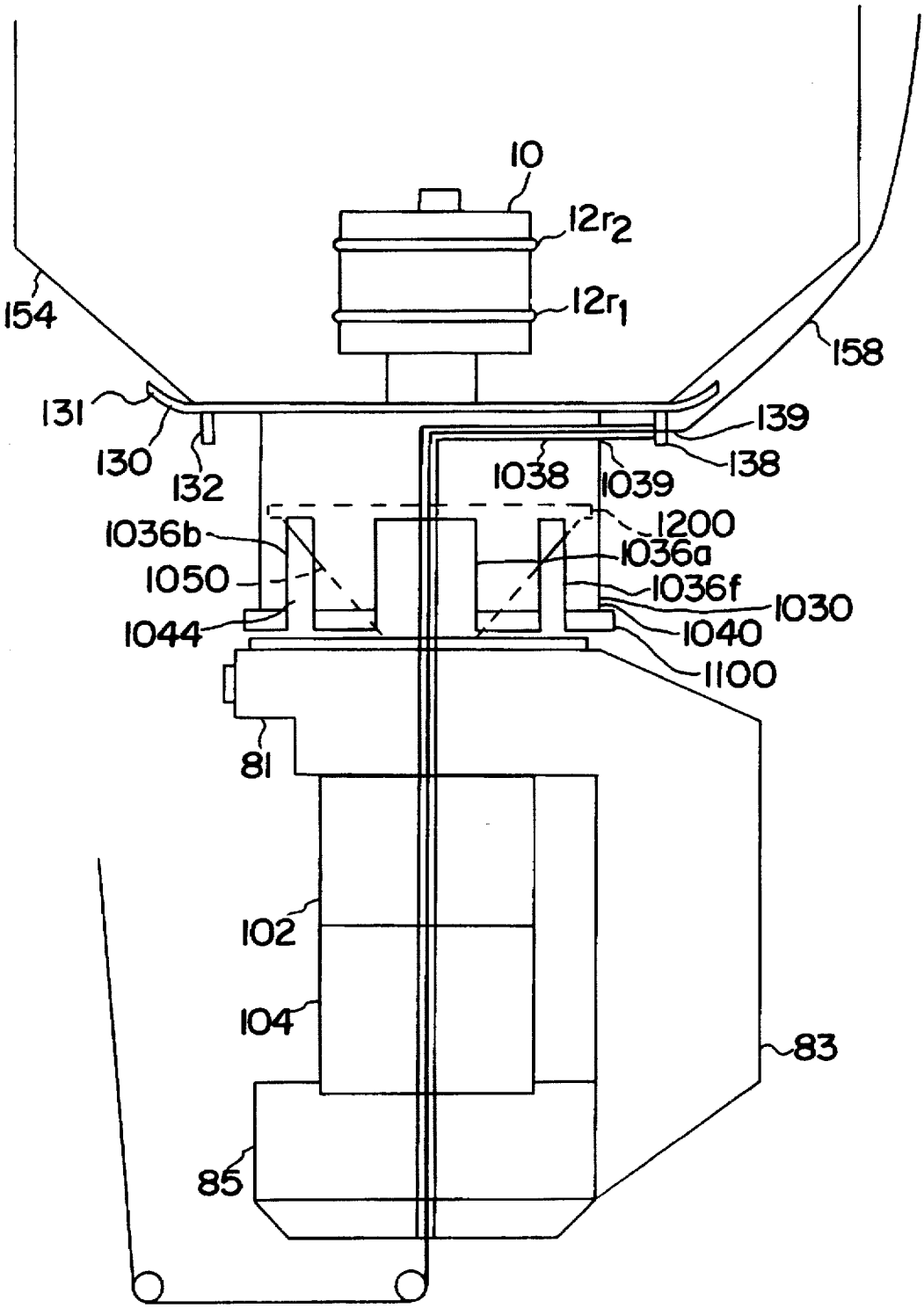
FIG. 16 is an orthographic side view of another embodiment of a yarn spindle according to the present invention, with the thread spool depicted, in part, with phantom lines.

A second embodiment of yarn spindle 1 according to the present invention is depicted in FIG. 16. Identical reference numerals have been employed for parts of spindle 1 already described above with respect to the first embodiment of yarn spindle 1. The second embodiment of spindle 1 is similar to that of the first embodiment, with the exception of the cylinder 1030 and the thread spool 1050.

Figure 18:
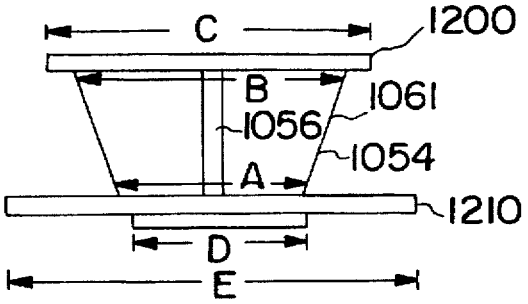
FIG. 18 is an orthographic side view of the thread spool of the cylinder of the yarn spindle as depicted in FIG. 16.

Referring now to FIG. 18, the thread spool 1050 is similar to the thread spool 50 of the first embodiment, but has a flange 1200 explained below in detail. Spool 1050 includes a frusto-conical barrel portion 1054 and a base 1210. The top surface of base 1210 is preferably flush with the top surface of lip 90 (FIG. 2) of spindle 1. The inclined outer wall of barrel portion 1054 is designated by reference numeral 1061.

Atop spool 1050 is disposed a disc-like flange 1200, located at the top of inclined side surface 1061 of barrel portion 1054. The flange 1200 is preferably approximately ⅛" thick, and extends approximately ⅛" out in a radial direction over the top of the side surface 1061. The flange 1200 prevents yarn fragments from flowing up over the top of the thread spool 1050 when the spool is filled to capacity, thereby preventing fouling of the drive shaft and bearings.

Additionally, a waste yarn removal slot 1056 is machined into or formed on the inclined side surface 1061 of barrel portion 1054 at a circumferential position generally facing toward central connector portion 83 (FIG. 2) of the spindle 1.

Preferably, the barrel portion 1054 has a diameter of 1 15/16" at its top end (dimension B in FIG. 18), and 1⅝" at the bottom end adjacent to the base 1210 (dimension A). Other exemplary dimensions shown in FIG. 18 are as follows: C=2 3/16", D=1 5/32", E=2 21/32".

As can be seen from FIG. 16, the cylinder 1030 has a skirt 1040 which extends down proportionally further with respect to thread spool 1050 than the skirt 40 of the first embodiment. This configuration provides an increased overhang with respect to the top surface of thread spool 1050.

Figure 17A:
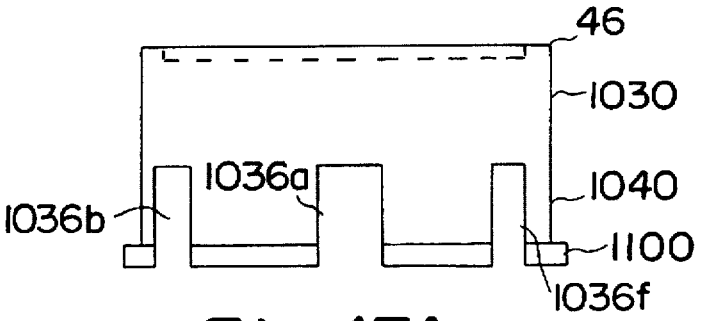
FIG. 17A is an orthographic side view of the cylinder of the yarn spindle as depicted in FIG. 16.

For example, the skirt 1040 overhangs the top end of flange 1200 preferably by 0.75" to 0.80". As shown in FIGS. 16 and 17A, extending radially outward from the bottom of skirt 1040 is an annular ledge or lip 1100. The distance between the top of rim 46 to the bottom of cylinder 1030, i.e., ledge 1100, is preferably approximately 1 11/16". Preferably, lip 1100 is about 3/16" in radial width, and about 3/16" in axial height. The gap between the bottom surface of lip 1100 and the top surface of spindle 1 housing (i.e. the top surface of spool base 1210) is preferably approximately 0.010".

Figure 17B:
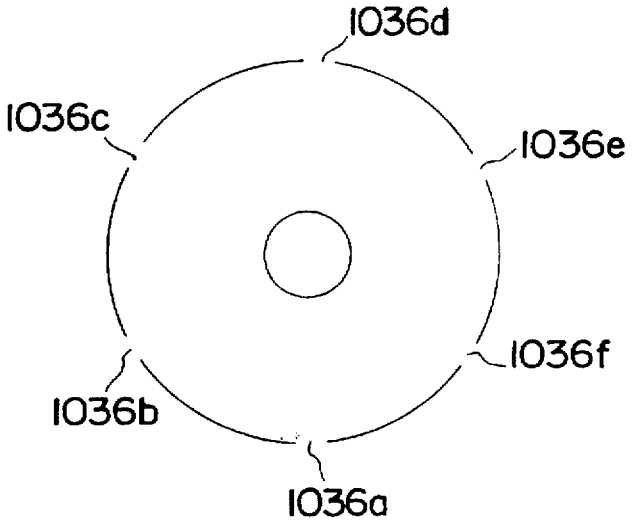
FIG. 17B is a schematic overhead view of the cylinder of the yarn spindle as depicted in FIG. 16.

Six thread cutting slots 1036*a*, 1036*b*, 1036*c*, 1036*d*, 1036*e*, and 1036*f* are disposed at approximately equal intervals along the bottom edge of skirt 1040 (See FIG. 17B depicting the approximately equal spacing of the thread cutting slots in a schematic fashion). Each slot is preferably about ¾" in depth (i.e., axial height). This represents a distance which is mere than 40% (i.e., 44%) of the axial height of the cylinder 1030, i.e., from the top of rim 46 to the bottom of ledge 1100. Thread cutting slots 1036*b*, 1036*c*, 1036*e*, and 1036*f* are preferably approximately ¼" wide. Thread cutting slots 1036*a* and 1036*d* are preferably about twice as wide as the other four thread cutting slots, i.e. approximately ⅜" wide. The embodiment discussed above affords the operator easier access to the waste yarn removal slot 1056 (FIG. 18).

In operation, the thread cutting slots 1036*a–f* of cylinder 1030 serve to shorten the revolving yarn tail after breakage of the yarn. The slots also sever yarn tails that have wrapped around spool 1050. Such severing leaves a waste yarn fragment wrapped around the barrel portion 1054. Such shortening and severing is similar to that discussed above with respect to the first embodiment.

In this second embodiment, the flange 1200 of spool 1050 affords added protection against jamming, as discussed above. The lip 1100 also provides another form of anti-choking protection for spindle 1. A very fine DPF yarn, instead of being cut by thread cutting slots 1036*a–f*, may instead wind in a continuous strand around the outer circumferential surface of the cylinder 1030. The lip 1100 provides a base for this winding, which tends to prevent the winding from wrapping around the spool 1050, where the very fine yarn would have a greater chance of pushing past flange 1200 and jamming the spindle. If the strand does not break, then the winding around cylinder 1030 may continue.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A cylinder mountable on a yarn spindle having a rotatable spindle shaft with an axially extending bore therein through which bore yarn passes, said cylinder having a yarn orifice through an outer surface thereof through which orifice the yarn passes, the yarn orifice communicating by means of a radially extending bore in said cylinder with the axially extending bore of the spindle shaft, said cylinder comprising cutting means, radially disposed from the rotatable spindle shaft, for cutting, and thus shortening, any free end of yarn extending from the yarn orifice as said cylinder rotates relative to the yarn.

2. A cylinder according to claim 1, wherein said cutting means comprises at least one thread cutting slot.

3. A cylinder according to claim 2, wherein the cylinder has a lower edge, and wherein each of said at least one thread cutting slots is disposed along said lower edge of the cylinder.

4. A cylinder according to claim 3, wherein a plurality of said thread cutting slots are spaced equally along said lower edge.

5. A cylinder according to claim 2, wherein the cylinder has at least four thread cutting slots.

6. A cylinder according to claim 2, wherein each of said at least one thread cutting slots is substantially rectangular in shape.

7. A cylinder according to claim 2, the cylinder comprising a downwardly extending circumferential skirt having a bottom edge, wherein each of said at least one thread cutting slots is disposed at the bottom edge of said skirt.

8. A cylinder according to claim 7, wherein each of said at least one thread cutting slots is a substantially rectangular notch passing through the thickness of said skirt.

9. A cylinder according to claim 2, the cylinder comprising a downwardly extending circumferential skirt having a bottom edge, and a radially extending annular lip disposed at the bottom edge, wherein each of said at least one thread cutting slots is disposed at the bottom edge of said skirt.

10. A cylinder according to claim 9, wherein the cylinder downwardly extends for approximately 0.35 to approximately 0.55 inch.

11. A cylinder according to claim 9, wherein the cylinder downwardly extends for approximately 0.75 to approximately 0.80 inch.

12. A yarn spindle according to claim 2, wherein said at least one thread cutting slot extends for a distance of 40% or more of an axial height of the cylinder.

13. An improved yarn spindle having a housing, a spindle drive shaft rotatably mounted in the housing, and a cylinder having a yarn orifice through which yarn passes, said cylinder being fixedly mounted on the spindle drive shaft, wherein the improvement comprises:

a waste thread spool statically disposed with respect to the spindle about the spindle drive shaft below the cylinder, the spool comprising a frusto-conical barrel with a top end, a bottom end, an axial hole, and an inclined outer wall, the radius of the barrel increasing from bottom to top, with the top end being adjacent the cylinder, wherein the spool shields the spindle drive shaft against contact with waste yarn.

14. A yarn spindle according to claim 13, wherein the outer wall of the barrel is angled approximately 30 to approximately 35 degrees from the vertical.

15. A yarn spindle according to claim 14, wherein the outer wall of the barrel has a groove therein that is substantially coplanar with the axial hole of the barrel.

16. A yarn spindle according to claim 13, wherein the spool further comprises a disc-shaped flange disposed at the top end of the barrel and radially overhanging the inclined outer wall of the barrel.

17. A yarn spindle according to claim 13, wherein the cylinder downwardly extends for approximately 0.35 to approximately 0.55 inch.

18. A yarn spindle according to claim 13, wherein the cylinder downwardly extends for approximately 0.75 to approximately 0.80 inch.

19. A yarn spindle according to claim 13, wherein the cylinder comprises:

a downwardly extending circumferential skirt having a bottom edge;

a radially extending annular lip disposed at the bottom edge; and at least one thread cutting slot disposed at the bottom edge of said skirt.

20. A yarn spindle according to claim 13, wherein said cylinder comprises at least one thread cutting slot.

21. A yarn spindle according to claim 20, wherein said at least one thread cutting slot extends for a distance of 40% or more of an axial height of the cylinder.

22. An improved yarn spindle having a housing, a spindle drive shaft rotatably mounted in the housing, and a cylinder having a yarn orifice through which yarn passes, the cylinder being fixedly mounted on the spindle drive shaft, wherein the improvement comprises:

the cylinder having a downwardly extending circumferential skirt defining an annular space between the skirt and the spindle drive shaft, the skirt having at least one thread cutting slot; and a waste thread spool statically disposed with respect to the spindle about the spindle drive shaft, the spool comprising a frusto-conical barrel having a top end, a bottom end, an axial hole, through which the spindle drive shaft passes, and an inclined outer wall, the radius of the barrel increasing from bottom to top, wherein the spool extends upward, underneath the skirt, into the annular space, with the top end of its barrel toward the cylinder.

23. A yarn spindle according to claim 22, wherein the top end of the barrel of the waste thread spool has an outer circumferential edge that is disposed with a radial clearance from the skirt of about 0.010 to about 0.020 inch.

24. A yarn spindle according to claim 23, wherein the clearance between the spindle drive shaft and the wall of the axial hole at the top end of the waste thread spool barrel is approximately 0.010 to approximately 0.050 inch.

25. A yarn spindle according to claim 23, wherein the skirt has a bottom edge, and wherein each of said at least one thread cutting slot is disposed at the bottom edge of the skirt.

26. A yarn spindle according to claim 25, wherein said at least one thread cutting slot extends for a distance of 40% or more of an axial height of the cylinder.

27. A yarn spindle according to claim 23, wherein each of said at least one thread cutting slot is a substantially rectangular notch passing through the thickness of the skirt.

28. A yarn spindle according to claim 22, wherein the skirt of said cylinder overhangs the top end of said spool barrel by at least about ¼ inch.

29. A yarn spindle according to claim 22, wherein the skirt of said cylinder overhangs the top end of said spool barrel by approximately 0.35 to approximately 0.55 inch.

30. A yarn spindle according to claim 22, wherein the skirt of said cylinder overhangs the top end of said spool barrel by approximately 0.75 inch to approximately 0.80 inch.

31. A yarn spindle according to claim 22, wherein the skirt further comprises a bottom edge and a radially extending annular lip disposed at the bottom edge and wherein each of said at least one thread cutting slot is disposed at the bottom edge of said skirt.

32. A yarn spindle according to claim 22, wherein the spool further comprises a disc-shaped flange disposed at the top end of the barrel and radially overhanging the inclined outer wall of the barrel.

33. A yarn spindle, comprising:

(a) a housing;

(b) a spindle drive shaft rotatably mounted in said housing;

(c) a cylinder having a yarn orifice through which yarn passes, said cylinder being fixedly attached to said spindle drive shaft, said cylinder comprising a downwardly extending circumferential skirt, said skirt and said spindle drive shaft defining an annular space between them, said skirt having a bottom edge with at least one thread cutting slot disposed therein, said slot being a substantially rectangular notch through the thickness of said skirt; and (d) a waste thread spool statically mounted on said housing, said spool comprising a frusto-conical barrel having a top end, an axial hole, and an inclined outer wall, the radius of said barrel increasing from bottom to top, wherein said barrel extends upward, underneath said skirt, into the annular space between said skirt and said spindle drive shaft.

34. A yarn spindle according to claim 33, further comprising a drive assembly for use with a drive belt, said drive assembly being coupled to and thereby powering said spindle drive shaft.

35. A yarn spindle according to claim 34, wherein said drive assembly comprises:

a drive roller coupled to said spindle drive shaft; and a shifting assembly for shifting the drive belt in and out of engagement with said drive roller.

36. A yarn spindle according to claim 33, wherein the skirt further comprises a bottom edge and a radially extending annular lip disposed at the bottom edge.

37. A yarn spindle according to claim 33, wherein the spool further comprises a disc-shaped flange disposed at the top end of the barrel and radially overhanging the inclined outer wall of the barrel.

38. A yarn spindle according to claim 33, wherein the skirt of said cylinder overhangs the top end of said spool barrel by approximately 0.35 inch to approximately 0.55 inch.

39. A yarn spindle according to claim 33, wherein the skirt of said cylinder overhangs the top end of said spool barrel by approximately 0.75 inch to approximately 0.80 inch.

40. A yarn spindle according to claim 33, wherein said at least one thread cutting slot extends for a distance of 40% or more of an axial height of the cylinder.

41. A yarn spindle, comprising:

(a) a housing;

(b) a spindle drive shaft rotatably mounted in said housing;

(c) a cylinder having a yarn orifice through which yarn passes, said cylinder being fixedly attached to said spindle drive shaft, said cylinder comprising a downwardly extending circumferential skirt, said skirt and said spindle drive shaft defining an annular space between them, said skirt having a bottom edge with at least four thread cutting slots disposed therein, each said slot being a substantially rectangular notch through the thickness of said skirt, and said at least four thread cutting slots being equally spaced about said bottom edge;

(d) a waste thread spool statically mounted on said housing for shielding said spindle drive shaft against contact with waste yarn, said spool comprising a frusto-conical barrel having a top end, a bottom end, an axial hole through which the spindle drive shaft passes, and an inclined outer wall, the outer wall being angled approximately 30 to approximately 35 degrees from the vertical and having a groove formed therein that is substantially coplanar with the axial hole of the barrel, the radius of said barrel increasing from bottom to top, wherein said barrel extends upward, underneath said skirt, into the annular space between said skirt and said spindle drive shaft, wherein the top end of said barrel of said waste thread spool has an outer circumferential edge that is disposed with a radial clearance from said skirt of about 0.010 to about 0.020 inch, wherein the clearance between the spindle drive shaft and the wall of the axial hole at the top end of the barrel of said waste thread spool is approximately 0.010 to approximately 0.050 inch, and wherein the skirt of said cylinder overhangs the top end of said barrel by approximately 0.35 to approximately 0.55 inch; and (e) a drive assembly for use with a drive belt, said drive assembly being coupled to and thereby powering said spindle drive shaft, said drive assembly comprising a drive roller coupled to said spindle drive shaft and a shifting assembly for shifting the drive belt in and out of engagement with said drive roller.

42. A yarn spindle, comprising:

(a) a housing;

(b) a spindle drive shaft rotatably mounted in said housing;

(c) a cylinder having a yarn orifice through which yarn passes, said cylinder being fixedly attached to said spindle drive shaft, said cylinder comprising a downwardly extending circumferential skirt, said skirt and said spindle drive shaft defining an annular space between them, said skirt having a bottom edge with at least four thread cutting slots disposed therein, each said slot being a substantially rectangular notch through the thickness of said skirt, and said at least four thread cutting slots being equally spaced about said bottom edge and extending for a distance of 40% or more of an axial height of the cylinder;

(d) a waste thread spool statically mounted on said housing for shielding said spindle drive shaft against contact with waste yarn, said spool comprising a frusto-conical barrel having a top end, a bottom end, an axial hole through which the spindle drive shaft passes, and an inclined outer wall, the outer wall being angled approximately 30 to approximately 35 degrees from the vertical and having a groove formed therein that is substantially coplanar with the axial hole of the barrel, the radius of said barrel increasing from bottom to top, wherein the spool further comprises a disc-shaped flange disposed at the top end of the barrel and radially overhanging the inclined outer wall of the barrel, wherein said barrel extends upward, underneath said skirt, into the annular space between said skirt and said spindle drive shaft, wherein the top end of said barrel of said waste thread spool has an outer circumferential edge that is disposed with a radial clearance from said skirt of about 0.010 to about 0.020 inch, wherein the clearance between the spindle drive shaft and the wall of the axial hole at the top end of the barrel of said waste thread spool is approximately 0.010 to approximately 0.050 inch, and wherein the skirt of said cylinder overhangs the top end of said barrel by approximately 0.75 to approximately 0.80 inch, and wherein the skirt further comprises a bottom edge and a radially extending annular lip disposed at the bottom edge, each of said at least one thread cutting slot being disposed at the bottom edge of the skirt; and (e) a drive assembly for use with a drive belt, said drive assembly being coupled to and thereby powering said spindle drive shaft, said drive assembly comprising a drive roller coupled to said spindle drive shaft and a shifting assembly for shifting the drive belt in and out of engagement with said drive roller.

* * * * *